US012800143B2

(12) United States Patent
Makwana et al.

(10) Patent No.: US 12,800,143 B2
(45) **Date of Patent: *Nov. 17, 2026**

(54) BURNER AND METHOD OF OPERATION

(71) Applicant: Air Products and Chemicals, Inc., Allentown, PA (US)

(72) Inventors: Anandkumar Makwana, Breinigsville, PA (US); Mark Daniel D'Agostini, Allentown, PA (US)

(73) Assignee: Air Products and Chemicals, Inc., Allentown, PA (US)

( * ) Notice: Subject to any disclaimer, the term of this patent is extended or adjusted under 35 U.S.C. 154(b) by 592 days.

This patent is subject to a terminal disclaimer.

(21) Appl. No.: 18/233,393

(22) Filed: Aug. 14, 2023

(65) Prior Publication Data

US 2025/0060095 A1 Feb. 20, 2025

(51) Int. Cl.
*F23D 14/24* (2006.01)
*F23C 1/00* (2006.01)
*F23C 7/00* (2006.01)

(52) U.S. Cl.
CPC ..... *F23D 14/24* (2013.01); *F23C 1/00* (2013.01); *F23C 7/002* (2013.01)

(58) Field of Classification Search
CPC ..... F23D 14/22; F23D 17/002
USPC ..... 431/6, 187, 284
See application file for complete search history.

(56) References Cited

U.S. PATENT DOCUMENTS

| | | | |
|---|---|---|---|
| 4,748,919 A | 6/1988 | Campobenedetto et al. | |
| 5,308,239 A | 5/1994 | Bazarian et al. | |
| 5,871,343 A | 2/1999 | Baukal, Jr. et al. | |
| 6,019,595 A | 2/2000 | Wulfert et al. | |
| 6,835,360 B2 | 12/2004 | Warren | |
| 6,951,454 B2 | 10/2005 | Sarv et al. | |
| 7,901,204 B2 | 3/2011 | Stephens et al. | |
| 8,727,767 B2 | 5/2014 | Watson et al. | |
| 8,899,969 B2 | 12/2014 | Gard et al. | |
| 9,664,381 B2 | 5/2017 | Gangoli et al. | |
| 2002/0197574 A1 | 12/2002 | Jones et al. | |
| 2004/0146821 A1 | 7/2004 | Joshi | |
| 2009/0113893 A1 | 5/2009 | Li et al. | |
| 2014/0069079 A1 | 3/2014 | Koizumi et al. | |
| 2016/0076763 A1* | 3/2016 | Bätz | F23D 17/00 431/187 |
| 2016/0169505 A1 | 6/2016 | Ilchenko et al. | |

(Continued)

FOREIGN PATENT DOCUMENTS

| | | |
|---|---|---|
| AU | 684296 | 12/1997 |
| CN | 111336515 | 6/2020 |

(Continued)

OTHER PUBLICATIONS

Charles E. Baukal, Jr., "Oxygen-enhanced combustion", CRC press, 2010.

*Primary Examiner* — Vivek K Shirsat
(74) *Attorney, Agent, or Firm* — Jason M. Ploeger

(57) ABSTRACT

The invention relates to particular burners, particularly to non-premixed or partially-premixed fuel burners with flexibility to oxygen enrich the burner. Accordingly, said burners may be used in applications that needs operation of a burner in both air-fuel, and/or oxy-fuel and/or air-oxy-fuel mode depending on furnace operation needs. The invention further relates to furnaces including the burners and methods of operating the burners.

19 Claims, 20 Drawing Sheets

(56) References Cited

U.S. PATENT DOCUMENTS

| | | | | |
|---|---|---|---|---|
| 2018/0216828 | A1 | 8/2018 | Johansson et al. | |
| 2025/0060096 | A1* | 2/2025 | D'Agostini | F23D 14/58 |

FOREIGN PATENT DOCUMENTS

| | | |
|---|---|---|
| DE | 2530170 | 1/1977 |
| EP | 1850067 | 10/2007 |
| EP | 2014981 | 1/2009 |
| EP | 3967925 | 3/2022 |
| JP | S54141028 U | 10/1979 |
| JP | 2016191533 | 11/2016 |
| WO | 2022053176 | 3/2022 |

* cited by examiner

[5]

Step 2

Step 1

BURNER AND METHOD OF OPERATION

FIELD

The present invention relates to burners and particularly to industrial burners for gaseous fuels, and especially to burners that can e.g. both work as air-fuel or air-oxy-fuel burners.

BACKGROUND

In the prior art, many high temperature heating or melting pre-heating furnaces are designed with an air-fuel burner in mind.

Due to increase in product demand, manufacturers are looking to increase the productivity of the current operational plants. Additionally, increase in the scrutiny by emissions regulators require to improve the efficiency and reduce emissions of current furnace operation.

Furthermore, the need for decarbonization has resulted in increased pressure to shift towards use of low carbon-intensity fuels like hydrogen and ammonia in medium and high heating application industry.

There are several potential ways these challenges can be addressed.

First, fuel-flexible burners may be used, which can operate using any gaseous fuel such as natural gas ("NG"), liquefied petroleum gas ("LPG"), biogas, synthesis gas, hydrogen, ammonia or other gases, and meet the emissions and thermal performance criteria of the heating or melting furnace. Designing a fuel flexible gaseous fuel burner has several challenges depending on the burner type and design.

Apart from wide variation in the combustion behavior of these fuels (well documented in combustion literature), e.g. the differences in heating value, reaction rates and flammability limits of the gaseous fuels creates a challenge when designing a burner. For example, One challenge is that as one starts to replace NG with $H_2$, the total volumetric flow of gas starts to increase for the same MMBtu rating of the burner. The increased volumetric flow would impact the nozzle exit velocities that can, base on the burner design, impact the flame stability, heating profile of the flame, and emission characteristics of the burner.

Second, an air-oxy fuel (AOF) burner may be a viable solution as it helps to replace a part of air as an oxidizer using pure oxygen or oxygen enriched air as an oxidizer. AOF burners help to increase the productivity and thermal efficiency of a plant due to multiple reasons and these reasons are well documented in the literature [Baukal Jr, Charles E. Oxygen-enhanced combustion. CRC press, 2010]. Primary reasons include increased plant thermal efficiencies as the diluent nitrogen decreases thereby reducing the heat that is absorbed and carried away by nitrogen, and higher peak temperatures enabling higher heat transfer rate through flame radiation.

The magnitude of use of AOF burner benefits on process depends on the total oxygen enrichment of the burner. Baukal Jr, Charles E. Oxygen-enhanced combustion. CRC press, 2010 shows a plot of available energy vs. oxidizer composition at different exhaust temperatures. The present inventors observe that the available heat increases rapidly with initial air enrichment levels up to 35%-45% but with further increase in the enrichment level, the process benefits increase but at a less rapid pace. This is regarded important as available heat is an indirect measure of thermal efficiency. The said plot provides certain guidance on where furnace operators can potentially choose to operate the burner and/or the furnace at intermediate enrichment levels thereby optimizing the balance of process benefits and cost of oxygen.

Further challenges with AOF burners are NOx emissions, as the enrichment level of air increases the tendency of a burner to form NOx increases due to an increase in the local oxygen concentration. The thermal NOx formation continues to increase up to a certain level of enrichment (depending on the burner design it could peak somewhere between 40-60% enrichment level). By further increasing the enrichment level beyond 40%-60%, NOx emission starts to decrease as local $N_2$ concentration starts to decrease, and NOx formation continues to decrease as the burner operation moves towards pure oxy-fuel burner.

It is therefore a first object of the present invention to provide an advantageous burner which alleviates or overcomes one or more of the above challenges. The invention provides a burner that is fuel-flexible. This burner also allows operation in air-fuel and/or air-oxy-fuel mode without any burner modifications. Additionally, this burner produces low NOx under all these operating conditions.

Particular prior art designs of burners may be summarized as follows:

EP 3 967 925 A1 describes a burner having a different interior section as compared to the present invention.

U.S. Pat. Nos. 5,308,239 and 5,871,343 disclose burners with an air oxy fuel design having a different concept and NOx design strategy as opposed to the present invention.

U.S. Pat. No. 8,727,767 discloses a flat flame burner working in different modes as compared to the present invention.

AU 684296B2 discloses an air-fuel and air-oxy fuel burner having a different design with air being swirled around the fuel and oxygen jets as compared to the present invention.

SUMMARY OF THE INVENTION

Generally, the present invention relates to burners, particularly to burners that can be used in high heating applications, especially burners that require operation in air-fuel, oxy-fuel and/or air-oxy-fuel mode depending on furnace operation needs.

Specifically, the present invention relates to the subject-matter as defined in the claims.

The present particularly provides a burner that can be used in applications that needs operation of a burner in both air-fuel and air-oxy-fuel mode depending on furnace operation needs.

The burner of the invention helps to solve the above challenges by providing a new burner design that is fuel flexible (works e.g. with NG or $H_2$ and/or NG/$H_2$ mixtures), provides operational flexibility between air-fuel and air-oxy fuel mode, and low NOx and CO emissions for the air-fuel and air-oxy fuel mode.

Generally, the burners of the invention can be used in any application that, for example, needs high heating applications, specifically in applications like steam methane reforming, reheat furnaces in steel industry, or secondary melting furnaces.

In a general aspect, the invention provides a burner (1), comprising a ignition source (10), a primary fuel conduit (20) comprising a primary fuel outlet (22) having a multiplicity of primary fuel exit holes (23) for supply of a primary fuel into an ignition chamber (25), which ignition chamber (25) is positioned within the primary fuel conduit (20) extending from the primary fuel outlet (22) to the primary fuel conduit end plane (24), wherein the primary fuel conduit wall (29) comprises a plurality of bleed holes (28) at the position of the ignition chamber (25), a main oxidant conduit (30) for supply of a main oxidant, comprising an intermediate annular conduit (35) within in a downstream portion (5) of the burner, which intermediate annular conduit (35) is configured to allow splitting of the main oxidant into two portions, such that a first portion is introduced into the ignition chamber (25) via the plurality of bleed holes (28) to mix with the primary fuel, and a second portion is introduced into a swirler section (33), which is further comprised by the main oxidant conduit, a secondary fuel conduit (40) for supply of a secondary fuel, having a secondary fuel outlet (44) at its downstream end.

Further provided by the present invention are, among others, a furnace including the burner of the present invention as well as methods for operating said burners.

Particular (further) advantages of the burners of the present invention are disclosed herein below.

BRIEF DESCRIPTION OF THE DRAWINGS

The present invention will hereinafter be described in conjunction with the appended figures wherein like reference numerals denote like elements.

DETAILED DESCRIPTION

Figure 1A:
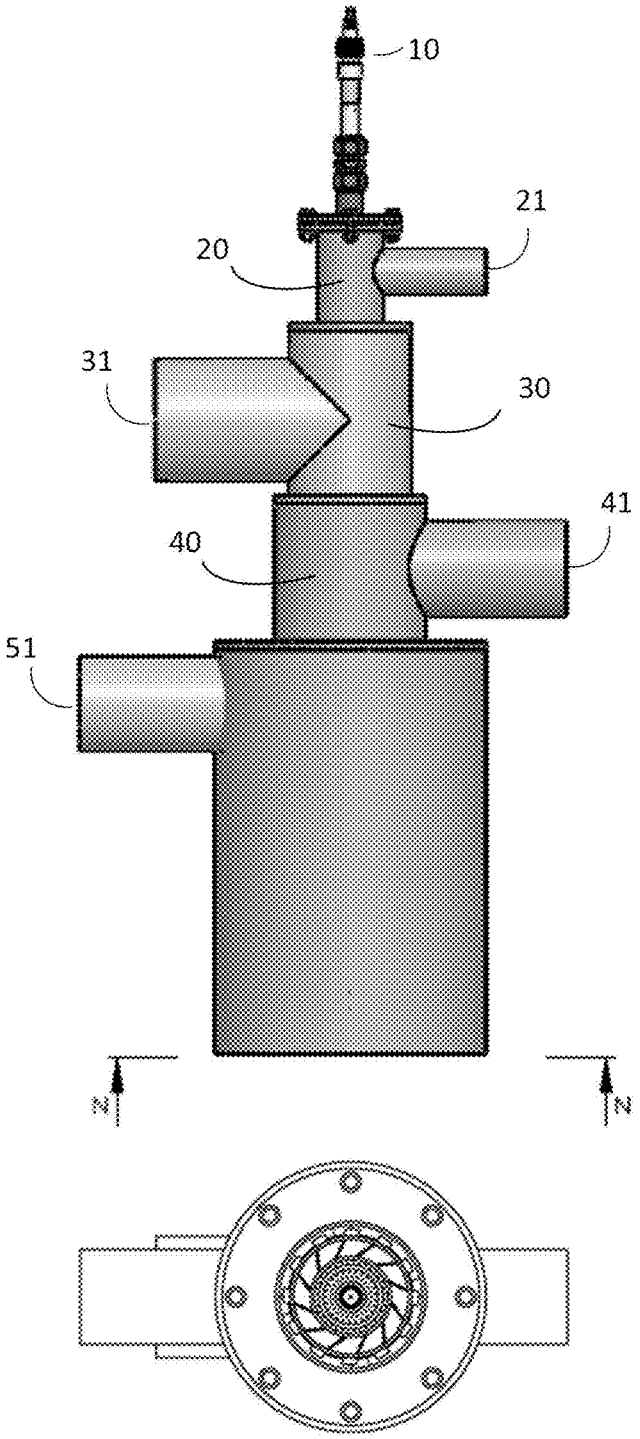
FIG. 1*a* is an exemplary side view of a downstream portion of an exemplary burner of the present invention including a cross section thereof at the downstream end. It particularly shows connectors of the respective conduits and a preferred arrangement having a central axis.
Figure 1B:
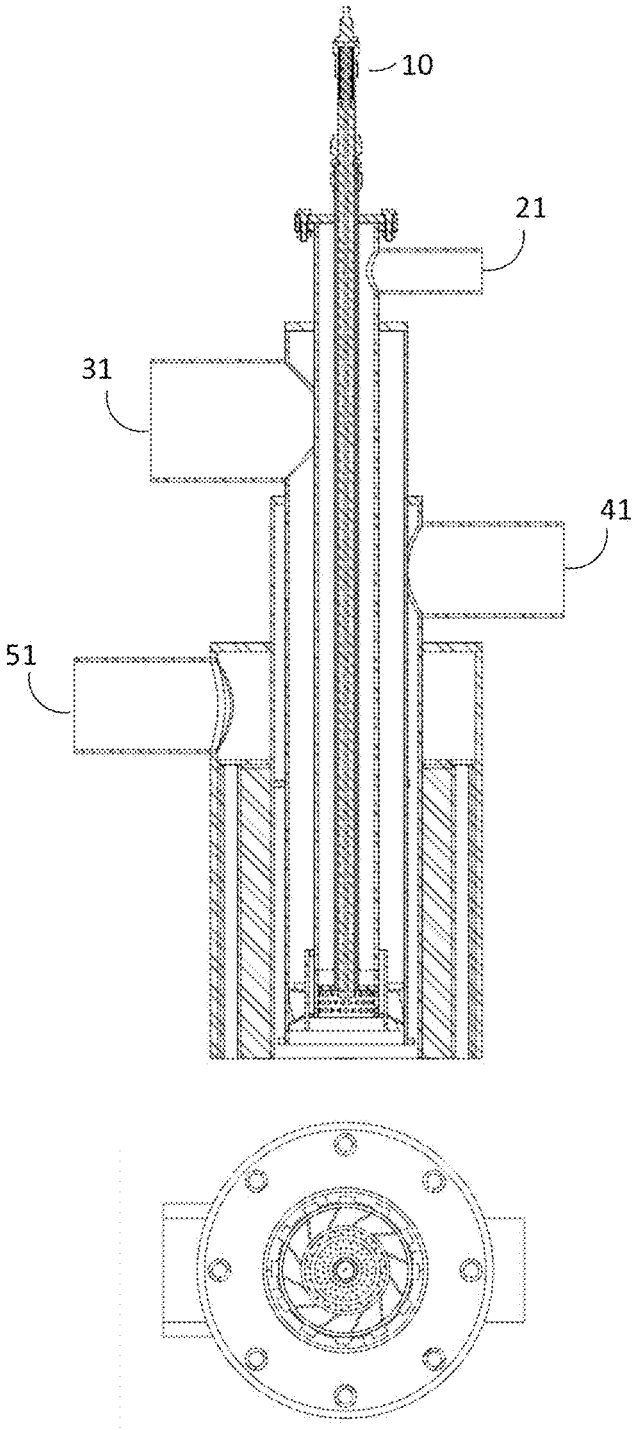
FIG. 1*b* is an exemplary side cross-sectional view of a downstream portion of an exemplary burner of the present invention including a cross section thereof at the downstream end. It particularly shows connectors of the respective conduits and a preferred arrangement having a central axis.
Figure 2A:
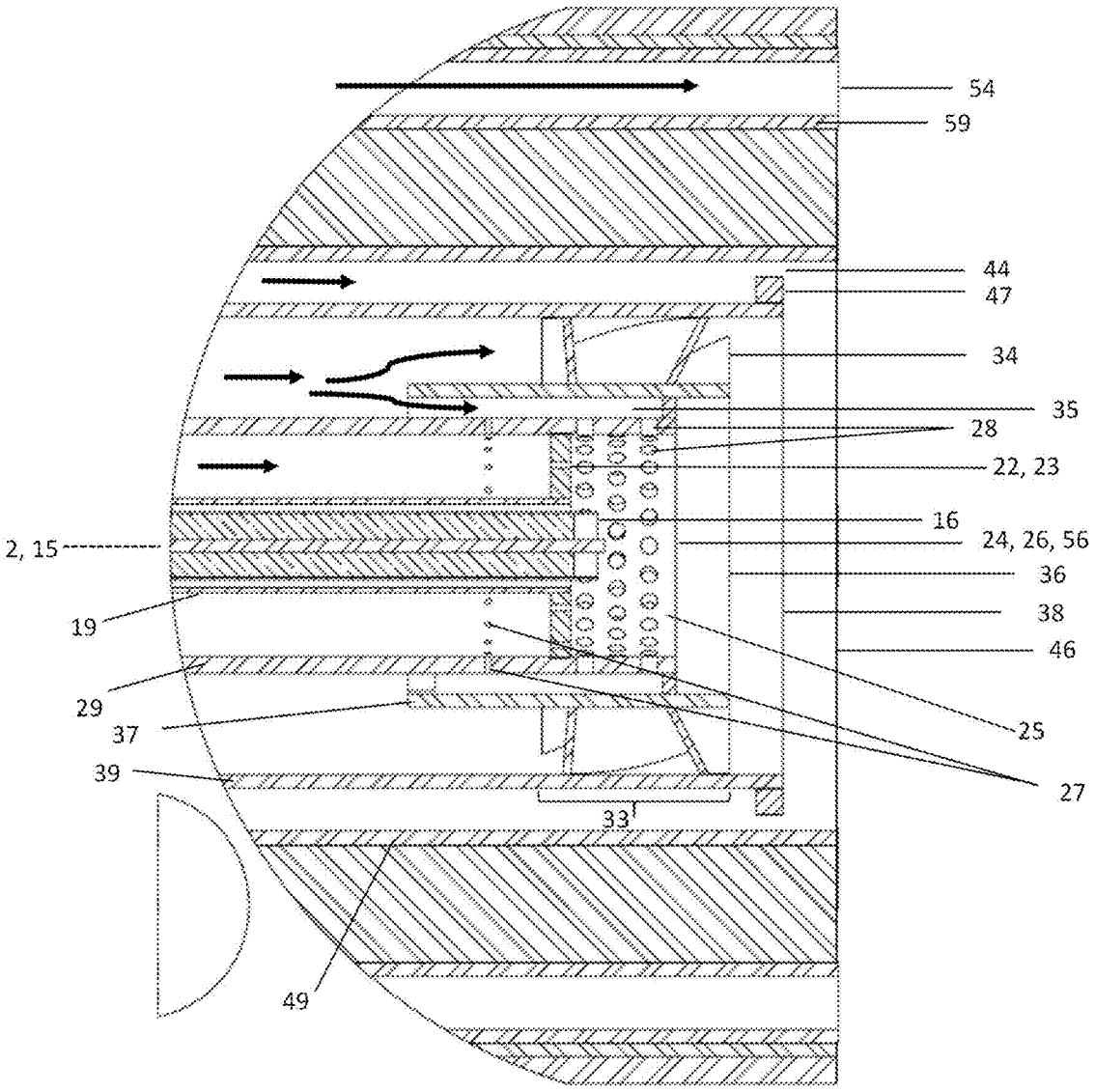
FIG. 2*a* is an exemplary side cross-sectional view of a downstream portion of a burner of the present invention e.g. showing the flow of various components, such as the primary and secondary fuels, the main oxidant (e.g. air, oxygen, or combinations therof), which splits into bleed hole section and a swirler section, as well as the optional staged oxidizer.
Figure 2B:
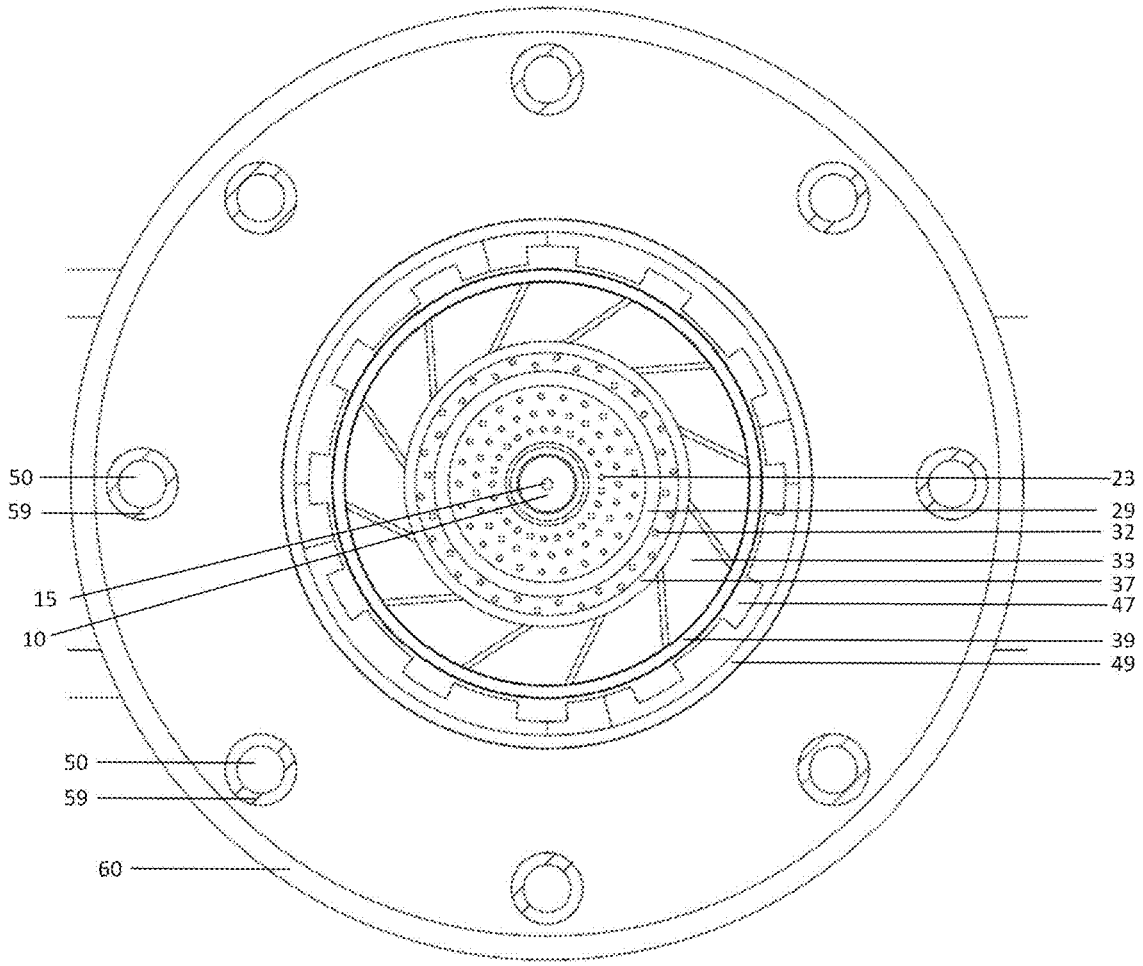
FIG. 2*b* is an exemplary cross-sectional view of a downstream portion of a burner of the present invention emphasizing various components and optional components, such as air bleed holes, turbulence generator plates and the conduits for the staged oxidizer.
Figure 3A:
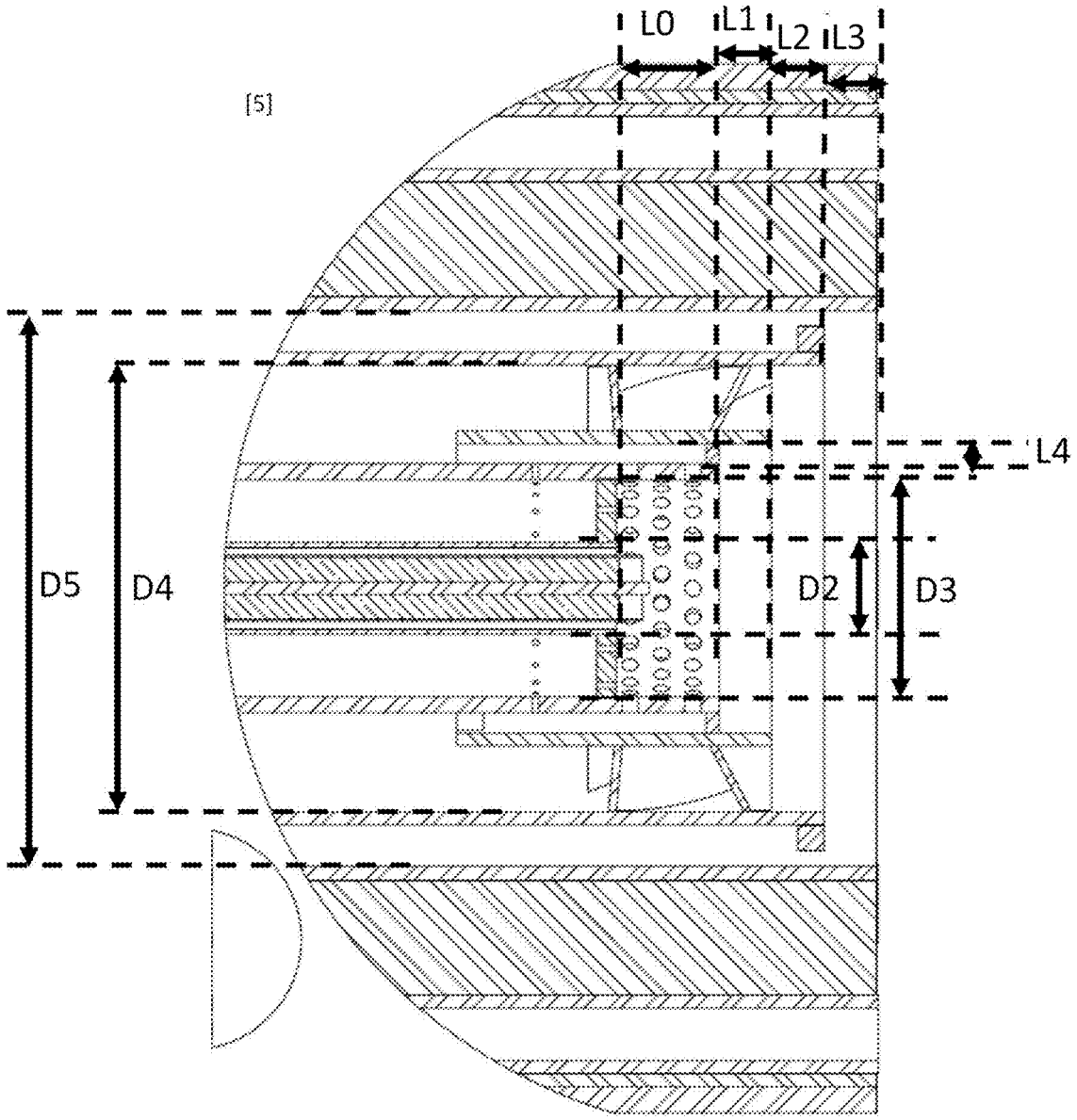
FIG. 3*a* is an exemplary side cross-sectional view of a downstream portion of a burner of the present invention emphasizing certain distances, diameters, and such like, such as dimensions of various conduits (or pipes, respectively), as well as certain distances between exit planes and outlets, respectively.
Figure 3B:
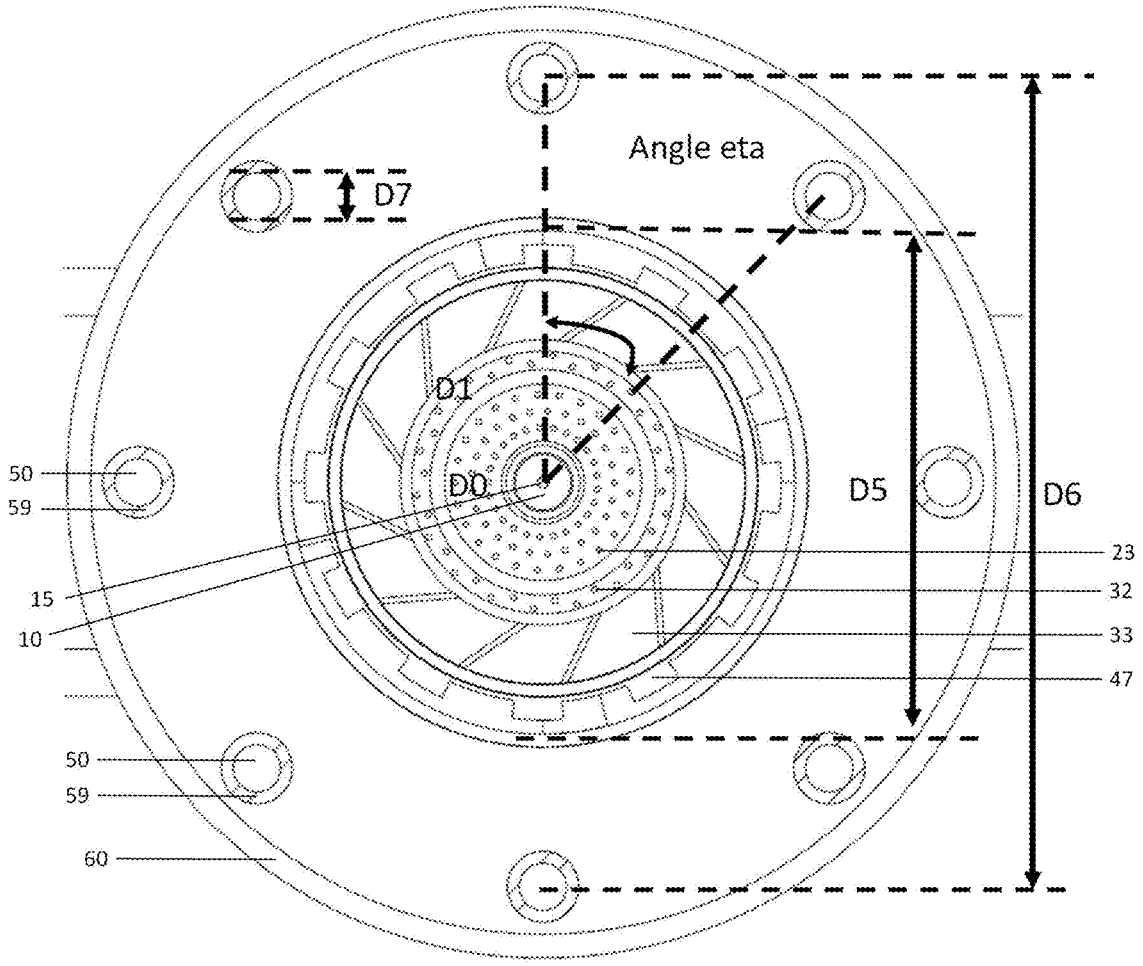
FIG. 3*b* is an exemplary cross-sectional view of a downstream portion of a burner of the present invention emphasizing certain distances, diameters, and such like, while indicating D0 as a diameter of primary fuel exit holes and D1 as a diameter of purge air exit holes.
Figure 4:
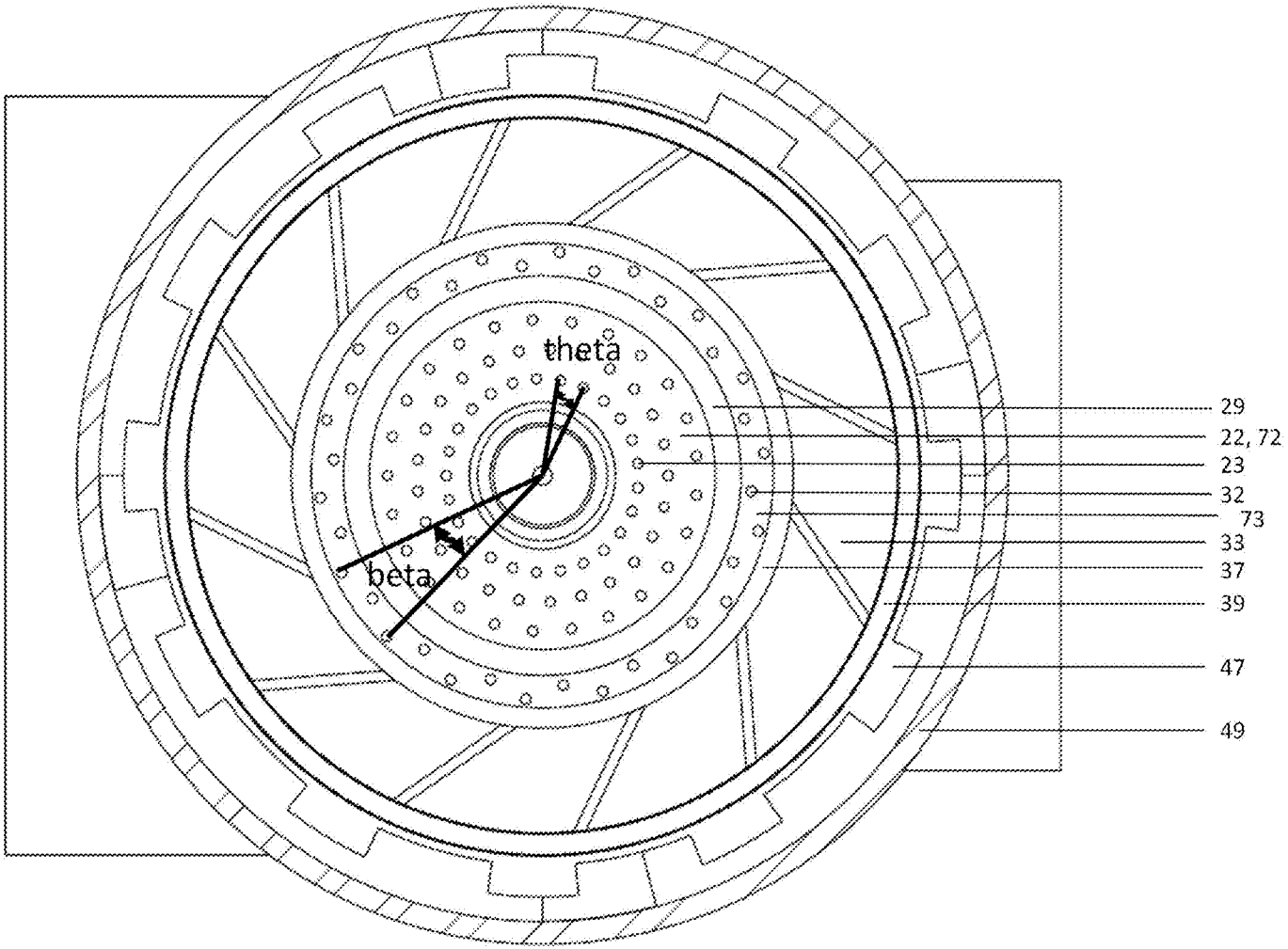
FIG. 4 is an exemplary cross-sectional view of a downstream portion of a burner of the present invention e.g. emphasizing the angles beta and theta and the use of a primary fuel plate as the primary fuel outlet as well as of an optional air purge plate for (a section of) the main oxidant. It further shows how consecutive holes in different rows of holes may be staggered by half the included angle between the two consecutive holes in one row.
Figure 5:
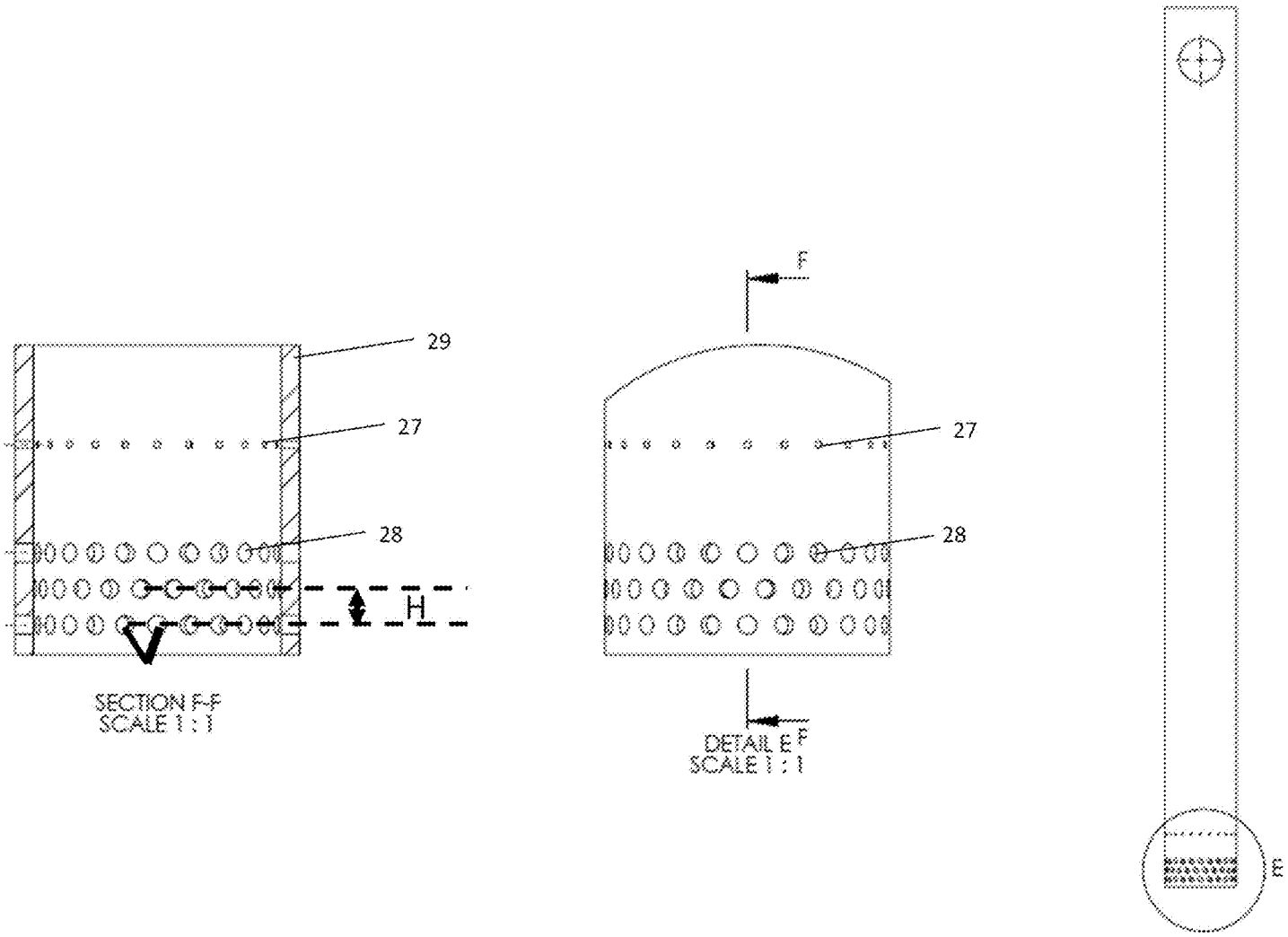
FIG. 5 includes schematic views of a primary fuel conduit in accordance with an embodiment of the present invention emphasizing a facultative arrangement of bleed holes (of diameter P1) and indicating optional air premixing holes, further emphasizing angle alpha, i.e. the angle between the center of two consecutive holes measured at the center of the conduit.

The present invention generally provides burners and further subject-matter as defined in the claims.

The burner of the present invention overcomes above-described prior art challenges in various ways.

For example, the burner can be operated in air-fuel mode in a cold furnace (that is <400 F average temp during start-up sequence of the burner) without the need of oxygen assistance or a continuous ignition source. The burner may further be stably operated in a fuel lean, low flame temperature mode The burner produces a stable flame (without any lift-off) over a very broad 1:30 turndown range, even with equivalence ratio as low as 0.25. This is an important feature to have, especially when the refractory are re-lined. The burner can be operated in air-fuel mode to cure the refractory using the air-fuel mode, which is typically low maximum temperature flame as compared to the oxy-fuel or air-oxy-fuel mode. These features enable pre-heating of the process furnace at a controlled rate to allow the process to initiate and come to a steady-state condition within a time-frame dictated by process requirements.

Moreover, the oxidizer back pressure (air and oxygen and/or enriched air) in the burners of the invention is such that it is not required to have any external secondary compression device for these streams. This feature helps to reduce the burner operating costs and any maintenance involved with such activities.

Furthermore, the burners of the invention provide low NOx performance while they can operate at (relatively seen) lower velocities as compared to requirement of Ma (Mach number)=1 or higher velocities for some burners, that would require high supply pressures. The increased supply requirements can potentially increase operational cost of the burner. NOx formation is primarily through prompt and thermal NOx formation. As will readily be understood by a person skilled in the art, thermal NOx formation depends on three parameters: local oxygen concentration, local nitrogen concentration and local temperatures.

Current burners use multiple strategies simultaneously to achieve low NOx performance. The three fluids, preferably air, fuel and oxygen/oxygen enriched air are supplied through different outlets/ports that are separated spatially thereby reducing the interaction of O2, N2 and high temperatures simultaneously at a local level.

Besides, the present burner design enables local interaction of either fuel/air, fuel/$O_2$ combustion thereby helping to increase the separation of zones of high temperatures (fuel/$O_2$ combustion) from air and hence, $N_2$.

Additionally, this burner design enables rapid and thorough mixing of a portion of the air-fuel mixture at the point of ignition. This is enabled via air entrainment in the fuel jet through a unique burner cup tip (ignition chamber) design, thereby allowing reducing peak temperatures relative to common characteristics of non-premixed burners. The lower peak temperatures for helps to reduce thermal NOx formation as compared to conventional air-fuel non-premixed combustion.

While fuel and/or oxidizer staging is a generally known technique to reduce the peak temperatures in a flame and lower NOx formation, the present burners may involve oxidizer staging to help with distributed combustion to lower peak temperatures and hence, NOx formation.

Besides, the burners of the invention may be further optimized through a fixed fuel split ratio such that no active control is required when shifting from air-fuel to air-oxy-fuel mode thereby reducing the cost of burner operation.

Finally, the two fuel supply ports play an important role when optimizing the burner operation to account for a change in fuel composition e.g. from NG or H2 to NG/H2 fuel mixtures based on fuel suppliers.

This burner allows to start/ignite the burner at low equivalence ratio (fuel lean start-ups) as low as 0.25, in particular in situations where it is not possible to reduce the air flow rate below a particular setpoint while start-up fuel flow is simultaneously minimized for safety reasons. The equivalence ratio is defined as the ratio of the actual fuel/air molar ratio to the stoichiometric fuel/air molar ratio.

In particular, in a first aspect herein, there is provided a burner (1), comprising a ignition source (10); a primary fuel conduit (20) comprising a primary fuel outlet (22) having a multiplicity of primary fuel exit holes (23) for supply of a primary fuel into an ignition chamber (25), which is positioned within the primary fuel conduit (20), and which is extending from the primary fuel outlet (22) to the primary fuel conduit end plane (24), wherein the primary fuel conduit wall (29) surrounding the ignition chamber (25) comprises a plurality of bleed holes (28); a main oxidant conduit (30) for supply of a main oxidant, comprising an intermediate annular conduit (35) in a downstream portion (5) of the burner, which intermediate annular conduit (35) is configured to allow splitting of the main oxidant, such that a first portion is introduced into the ignition chamber (25) via the plurality of bleed holes (28) to mix with the primary fuel; a secondary fuel conduit (40) for supply of a secondary fuel, having a secondary fuel outlet (44) at its downstream end; wherein at least in the downstream portion (5) of the burner (1), in which primary fuel outlet (22), ignition chamber (25), intermediate annular conduit (35) and secondary fuel outlet (44) are present, the primary fuel conduit (20) is surrounded by the main oxidant conduit (30) and the secondary fuel conduit (40).

As used herein, a "downstream portion of the burner" in which certain outlets "are present" refers to a downstream portion that comprises all of said outlets. Moreover, the said portion further comprises the swirler section and/or bleed holes.

The term "downstream portion" is used herein exchangeably herein with the term "downstream section".

In preferred embodiments herein, at least in the downstream portion (5) of the burner (1), in which primary fuel outlet (22), ignition chamber (25), intermediate annular conduit (35), and secondary fuel outlet (44) are present, the main oxidant conduit (30) and the secondary fuel conduit (40) are arranged essentially concentrically around the primary fuel conduit (20)

In particular embodiments of the present invention, where one or more given conduits are arranged (concentrically) around one or more given other conduits, said conduit(s) are arranged around another in a section corresponding to at least 20%, preferably in at least 30%, particularly in at least 40%, especially in at least 50%, and in some embodiments in at least 75%, of the total length of the burner, wherein the said section includes the primary fuel outlet, main oxidant outlet, secondary fuel outlet and auxiliary oxidant outlet. Moreover, in case that a swirler section and/or a bleed hole annulus is/are additionally present, the said portion preferably further includes the swirler section and/or bleed hole annulus.

Herein, the "total length" of the burner of the invention is determined by establishing the distance between the furthest upstream end of all conduits and the furthest downstream end of all conduits.

In a further preferred embodiment the primary fuel conduit, the main oxidant conduit and the secondary fuel conduit (and optionally the secondary oxidant conduit) are arranged concentrically around the central ignition source along their full length.

In preferred embodiments of the invention, where a given conduit is arranged concentrically around another conduit, this results in the formation of a respective annulus.

Consequently, in preferred embodiments herein, the burner is configured in such a way that the one or more fuels or oxidants flow through at least one annulus. In the present invention, such annuli may further be characterized by containing further elements of the respective conduits (such as exit holes, bleed holes, a swirler section and suchlike) as defined elsewhere herein.

Likewise, in preferred embodiments herein, the burner is characterized in that one or more outlets of the conduits are configured as annular rings. In the present invention, such annular rings may be characterized by containing further elements (such as exit holes, bleed holes, a swirler section and suchlike) as defined elsewhere herein.

Generally, in the present invention, a certain conduit (is described as being "surrounded" by a certain other conduit (or several other conduits, respectively) if said conduit has a smaller diameter than said other conduit(s) and is arranged inside said other conduit(s).

However, for being "surrounded" by another conduit, a given conduit does not need to be entirely surrounded by the other, but may also extend further downstream and/or upstream from the other. Respective definitions apply herein, where a given element is said to be "arranged around" another element.

In preferred embodiments, a conduit that is described to be surrounded by (an) other conduit(s) shares its longitudinal axis with the other(s).

In preferred embodiments, the ignition chamber (25) is extending from the primary fuel conduit exit plane (55) to the intermediate annular conduit exit plane (56).

In certain preferred embodiments, the ignition chamber (25) is characterized by at least two (preferably by two or three) steps in its wall, wherein each step comprises a rows of bleed holes (28).

In certain preferred embodiments, the ignition chamber (25) comprises a section having an outer diameter that is smaller than or equal to the inner diameter of the primary fuel conduit (20).

In certain preferred embodiments, the ignition chamber (25) further comprises a section having an inner diameter that is greater than the outer diameter of the primary fuel conduit (20), but having an outer diameter smaller than the inner diameter of the intermediate annular conduit (35).

More specifically, in one set of particularly embodiments, the burner is characterized in that the ignition chamber (25) is extending from the primary fuel outlet (22) to the intermediate annular conduit exit plane (56), wherein the wall surrounding the ignition chamber (25) comprises at least two (preferably two or three) steps of annular conduits with increasing diameter, each of which comprises a plurality of bleed holes (28).

In another set of particularly embodiments, the burner is characterized in that the ignition chamber (25) is extending from the primary fuel outlet (22) to the intermediate annular conduit exit plane (56), wherein the wall surrounding the ignition chamber (25) comprises two sections, wherein i) the first section is extending from the primary fuel outlet (22) to the primary fuel conduit end plane (24), wherein the primary fuel conduit wall (29) surrounding the section comprises a plurality of bleed holes (28), and ii) the second section has an inner diameter greater than the outer diameter of the primary fuel conduit (20), but the second section has an outer diameter smaller than the inner diameter of the intermediate annular conduit (35), and comprises a further plurality of bleed holes (28), and wherein iii) the burner optionally further comprises an air purge plate (73) with purge holes (32) that extends between the first section's outer diameter and the inner diameter of the second section, and iv) the burner optionally further comprises two mechanical mixer plates (74) each located downstream of and adjacent to the said two sections, and v) a purge plate (73) with purge holes (32) present between the outer diameter of the second section and inner diameter of the intermediate annular conduit (35).

Preferably, the mechanical mixer plates (74) have a disk type structure that breaks the fuel flow coming out of fuel exit holes (23). In particular, the first mechanical mixer plate has a disk type structure (mechanical mixer 1) that breaks the fuel flow coming out of the 'outer series' of fuel exit holes (23). The disk breaks these fuel jets and help with quick mixing of fuel and air inside the ignition chamber.

Preferably, the purge plate (73) is a disc that comprises purge holes (32). More preferably, the plate/disk is present between the fuel conduit wall (29) and the intermediate conduit wall present inside the conduit (35).

In a further set of particular embodiments, the burner is characterized in that wherein the ignition chamber (25) is extending from the primary fuel outlet (22) to the intermediate annular conduit exit plane (56), wherein the wall surrounding the ignition chamber (25) comprises two sections, wherein i) the first section has an outer diameter smaller than the inner diameter of the primary fuel conduit (20) and comprises a plurality of bleed holes (28), wherein the primary fuel conduit wall (29) surrounding the first section comprises a plurality of bleed holes (28), and wherein the first section further comprises means allowing the main oxidant to additionally enter the ignition chamber (25) in flow direction in between two rings of primary fuel exit holes, ii) the second section has an inner diameter greater than the outer diameter of the primary fuel conduit (20), but the second section has an outer diameter smaller than the inner diameter of the intermediate annular conduit (35), and comprises a further plurality of bleed holes (28), and wherein the burner optionally further comprises iii) a purge plate (73) with purge holes (32) present between the first section's outer diameter and inner diameter of the second section, and iv) a purge plate (73) with purge holes (32) present between the outer diameter of the second section and inner diameter of the intermediate annular conduit (35).

In certain preferred embodiments, the ignition chamber (25) comprises an ignition cup (75) as well as a bleed cup (76). Preferably wherein the ignition cup (75) is comprised in a first section of the ignition chamber (25), and the bleed cup (76) is comprised in a second section of the ignition chamber (25), wherein the second section is located downstream of the first section.

More specifically, in one set of particularly embodiments, the burner is characterized in that the ignition chamber (25) is extending from the primary fuel outlet (22) to the intermediate annular conduit exit plane (56), wherein the wall surrounding the ignition chamber (25) comprises two sections, wherein i) the first section has an outer diameter smaller than or equal to the outer diameter of the primary fuel conduit (20) and comprises a plurality of bleed holes (28), wherein the wall surrounding the first section comprises a plurality of bleed holes (28), and wherein the first section further comprises means allowing the main oxidant to additionally enter the ignition chamber (25) in flow direction, ii) the second section has an inner diameter greater than the outer diameter of the primary fuel conduit (20), but the second section has an outer diameter smaller than the inner diameter of the intermediate annular conduit (35), and comprises a further plurality of bleed holes (28). Preferably, the burner further comprises a purge plate (73) with purge holes (32) present between the first section's outer diameter and inner diameter of the second section. Preferably, the burner further comprises a purge plate (73) with purge holes (32) present between the outer diameter of the second section and inner diameter of the intermediate annular conduit (35). Preferably, the burner optionally further comprises a mechanical mixer plate (74) located downstream of and adjacent to the first section.

Preferably herein, the burner further comprises an ignition source (10), which preferably terminates in the ignition chamber (25).

In certain embodiments, the ignition source (10) is a central ignition source having a central axis (15) and a conduit end plane (16).

In preferred embodiments herein, the main axis (2) of the burner (1) coincides with the central axis (15) of the ignition source (10).

Preferably, at least in said downstream portion (5) of the burner (1), the central ignition source (10) is surrounded by the primary fuel conduit (20), the main oxidant conduit (30) and the secondary fuel conduit (40), and optionally the plurality of secondary oxidant conduits (50).

In certain embodiments, the main axis (2) of the burner (1) coincides with the central axis (15) of the ignition source (10).

Further as to the ignition source (10), same may be designated herein as "pipe 1".

The (central) ignition source may also be referred to herein simply as "igniter".

Herein, the outer diameter of the ignition source (10) may be defined as D2.

Accordingly, the central ignition source wall (19) may have an outer diameter D2.

Furthermore, the central ignition source is preferably arranged in the center of the burner, preferably along its full length, particularly wherein the remaining conduits of the burner are arranged concentrically around the central ignition source.

Further as to the primary fuel conduit (20), same may be designated herein as "pipe 2", which is a gaseous fuel pipe.

Herein, the inner diameter of the primary fuel conduit (20) may be defined as D3.

Accordingly, the primary fuel conduit wall (29) may have an inner diameter D3.

In certain embodiments, the primary fuel conduit end plane (24) corresponds to the ignition chamber end plane (26).

The primary fuel conduit (20) further comprises a primary fuel outlet (22). In certain embodiments, said primary fuel outlet (22) is configured as a plate comprising primary fuel exit holes (23), particularly as an air purge plate comprising primary fuel exit holes (23).

The primary fuel conduit (20) may further comprise a particular primary fuel connector (21).

Herein, the distance between the primary fuel outlet (22) and the primary fuel conduit end plane (24) and/or ignition chamber end plane (26) may be defined as L0. Accordingly, in certain embodiments, the primary fuel outlet (22) is recessed in upstream direction from the primary fuel conduit end plane (24) by a distance L0. Preferably, the primary fuel conduit end plane (24) corresponds to the ignition chamber end plane (26).

In the burners herein, the primary fuel conduit (20), more specifically the primary fuel outlet (22), further comprises primary fuel exit holes (23). Accordingly, the primary fuel outlet (22) may also be designated herein a "fuel distribution nozzle". Said outlet/nozzle maybe described as having a multiplicity of holes introducing the primary-fuel into an ignition chamber.

Herein, the diameter of the primary fuel exit holes (23) may be defined as DO. Preferably, D0/D2 is between 0.04 and 0.5.

In particular embodiments, the primary fuel exit holes (23) are located on concentric circles around the center of the primary fuel exit plate. Preferably the total number of concentric circles are in the range of 2-7, more preferably the total number of concentric circles is between 2-5. Preferably, the holes are of circular shape. The holes can be any other shape such as stars, triangles, double-stars, rectangle, etc.

Without intending to be bound by theory, such size significantly contributes to the ability to quickly mix the fuel with surrounding air.

Herein, the circumferential angle defined by the main axis (2) of the burner and the centers of two adjacent primary fuel exit holes (23) may be defined as angle theta.

In the burners herein, the primary fuel conduit (20) further comprises bleed holes (28).

Herein, the inner diameter of the bleed holes (28) may be defined as P1. Preferably, P1/D2 is between 0.05 and 0.4.

In particular embodiments, the bleed holes (28) are arranged in rows around the primary fuel conduit. Preferably there will be no more than 5 rows of bleed holes; more preferably no more than 3 rows of bleed holes. Preferably, the holes are of circular shape. The holes can be any other shape such as stars, triangle, double-stars, rectangle, etc.

Herein the axial distance between two rows of bleed holes (28) measured between their centers may be defined as H.

Herein, the circumferential angle defined by the main axis (2) of the burner and the centers of two adjacent bleed holes (28) may be defined as angle alpha.

In particular embodiments herein, the primary fuel conduit (20) further comprises air premixing holes (27), preferably upstream of the primary fuel outlet (22).

Herein, the diameter of the air premixing holes (27) may be defined as P0. Preferably, P0/D2 is between 0.02 and 0.2.

In particular embodiments, the air premixing holes (27) are arranged in rows around the primary fuel conduit. Preferably there will no more than 5 rows of premixing holes. More preferably there will be no more than 3 rows of premixing holes. Preferably, the holes are of circular shape. The holes can be any other shape such as stars, triangle, double-stars, rectangle, etc.

Herein, the distance between the primary fuel conduit wall (29) and the intermediate annular conduit wall (37) may be defined as L4.

Further as to the main oxidant conduit (30), same may be designated herein as "pipe 3", particularly as an air pipe.

Herein, the inner diameter of the main oxidant conduit (30) may be defined as D4.

Accordingly, the main oxidant conduit wall (39) may have an inner diameter D4.

Herein, the distance between the intermediate annular conduit end plane (36) and the main oxidant conduit end plane (38) may be defined as L2. Accordingly, in certain embodiments, the intermediate annular conduit end plane (36) is recessed in upstream direction from the main oxidant conduit end plane (38) by a distance L2.

In the burners herein, the main oxidant conduit (30) further comprises an intermediate annular conduit (35).

In the present invention, the intermediate annular conduit (35) is configured to allow splitting of the main oxidant into two portions, such that a first portion is introduced into the ignition chamber (25) via a plurality of bleed holes (28) as defined above.

The first portion is preferably about 20% of the total volumetric flow. In particular embodiments, the first portion is in the range of 2%-40%, preferably the range is 10% to 25%.

In preferred embodiments herein, the first portion of the main oxidant enters into the ignition chamber at a right angle to the primary fuel outlet. (via the peripheral wall of the chamber).

Accordingly, in preferred embodiments herein, the first portion of the main oxidant enters into the ignition chamber in a direction that is prependicular to the flow direction of the primary fuel.

Without intending to be bound by theory, this serves to vigorously mix the fuel and "ignition" air such that peak flame temperatures are reduced compared with typical diffusion flames. This is regarded important for minimization of flame-generated NOx emissions. Moreover, the method of air introduction also keeps the peripheral wall cooled by protecting it from direct contact with the flame.

Herein, the distance between the primary fuel conduit end plane (24) and the intermediate annular conduit end plane (36) may be defined as L1. Accordingly, in certain embodiments, the primary fuel conduit end plane (24) is recessed in upstream direction from the intermediate annular conduit end plane (36) by a distance L1.

In preferred embodiments of the present invention the burners are characterized in that the main oxidant conduit (30) further comprises a swirler section (33).

Accordingly, the intermediate annular conduit (35) is preferably configured to allow splitting of the main oxidant into two portions, wherein a second portion is introduced into a swirler section (33).

In particular, in preferred embodiments herein, the annular conduit (35) is configured to allow splitting of the main oxidant into two portions, such that a first portion is introduced into the ignition chamber (25) via the plurality of bleed holes (28) to mix with the primary fuel, and a second portion is introduced into a swirler section (33), which further comprises the main oxidant conduit.

Without intending to be bound by theory, the second portion of air introduced into the swirler section induces a strong tangential flow field in the combustion chamber that acts to increase the rate of mixing among the oxidant and fuel, while also creating a compact flame and one that does not contain appreciable soot.

Again without intending to be bound by theory use of a swirler to swirl the air is well-known in the field of combustion. The primary function of the swirl is to provide a tangential flow to e.g. the air exiting pipe 3 and create a recirculation zone at the center that brings in hot combustion gases back towards the burner exit plane providing a continuous source of ignition to the fresh reactants. The upper and lower bound of the swirl angle is determined by the length of the furnace, and burner firing rate.

Preferably, the swirl angle is from 5 to 60 degrees, preferably from 30 to 45 degrees.

As used herein, a "swirl angle" is defined to be the angle between a plane that is nominally tangent to the outlet of the swirler blades and the plane parallel to the main axis of the burner.

Preferably herein, the swirl number (which is defined herein as the ratio of the axial flux of the tangential momentum and the axial flux of the axial momentum) is in the range from 0.1 to 1.5.

In certain embodiments, the main oxidant conduit (30) further comprises purge holes (32) located on the air purge plate (73), particularly in flow direction parallel to the main axis (2) of the burner.

Herein, the diameter of the purge holes (32) may be defined as D1. Preferably, D1/D2 is between 0.04 and 0.5.

In particular embodiments, the purge holes (32) are arranged in circular way on different concentric diameters as 1-7 row, preferably 1-3 concentric diameters of holes. Preferably, the holes are of circular shape. The holes can be any other shape such as stars, triangle, double-stars, rectangle, etc.

Herein, the circumferential angle defined by the main axis (2) of the burner and the centers of two adjacent purge holes (32) may be defined as angle beta.

The main oxidant conduit (30) may further comprise a particular main oxidant connector (31).

Further as to the secondary fuel conduit (40), same may be designated herein as "pipe 4", which is a gaseous fuel pipe.

Herein, the inner diameter of the secondary fuel conduit (40) may be defined as D5.

Accordingly, the secondary fuel conduit wall (49) may have an inner diameter D5.

In certain embodiments, the burner (1) further comprises a turbulence generator (47) in the secondary fuel conduit (40).

A turbulence generator may also be referred to herein as means for generating turbulences or turbulence generator means, respectively. Same may comprise one or more turbulence generator disk(s) or turbulence generator plates, respectively. Preferably, said turbulence generator means are arranged at an additional wall of the secondary fuel conduit, which is positioned next to the wall of the main oxidant conduit.

Herein, wherein the distance between the main oxidant conduit end plane (38) and the secondary fuel conduit end plane (46) may be defined as L3. Accordingly, in certain embodiments, main oxidant conduit end plane (38) is recessed in upstream direction from the secondary fuel conduit end plane (46) by a distance L3. Preferably, the secondary fuel conduit end plane (46) corresponds to the secondary oxidant conduit end plane (56).

The secondary fuel conduit (40) may further comprise a particular secondary fuel connector (41).

In preferred embodiments of the invention, the burner further comprises a plurality of secondary oxidant conduits (50) for supply of a secondary oxidant (e.g., air, oxygen, or combinations thereof). Herein, the latter may also be designated as a "secondary oxidizer".

Preferably, those conduits are arranged as an outer ring of conduits. The conduits are used for oxygen enrichment.

In preferred embodiments of the invention, those secondary oxidant conduits (50) may have turbulence generating devices (57) to increase the mixing of the jets with combustion atmosphere and/or may be angled inwards towards the center of the burner by a certain angle (preferably 0.2 to 25 degrees, more preferably 0.25 to 10.0, more preferably 0.5 to 5.0).

In preferred embodiments, the secondary oxidant is oxygen of 80% to 100% by volume purity. In preferred alternative embodiments, the secondary oxidant is 23% to 50% by volume (oxygen) enriched air.

Without intending to be bound by theory, this configuration helps to spatially separate the oxygen/oxygen enriched air inlet from the fuel inlet; thereby enabling delayed mixing and combustion—and resulting in a flameless/low NOx burner.

Herein, the distance between the centers of two secondary oxidant conduits (50) located opposite from each other in relation to the main axis (2) of the burner may be defined as D6.

Herein, the inner diameter of the secondary oxidant conduits (50) may be defined as D7.

Accordingly, the secondary oxidant conduit wall (59) may have an inner diameter D7.

Herein, the angle defined by the main axis (2) of the burner and the centers of two adjacent secondary oxidant conduits (50) may be defined as angle eta.

The burners of the present invention are designed to operate using any gaseous fuels like natural gas (NG), hydrogen (H2), LPG, biogas, synthesis gas, ammonia or other gases Hence, in accordance with the present invention, the primary fuel used in the burner is any gaseous fuel. In preferred embodiments, it is selected from the group consisting of natural gas (NG), hydrogen (H2), LPG, biogas, synthesis gas and ammonia. In other embodiments, it is selected from natural gas (NG), mixtures of NG/$H_2$ and hydrogen.

In accordance with the present invention, the secondary fuel is any gaseous fuel. In preferred embodiments, it is selected from the group consisting of natural gas (NG), hydrogen (H2), LPG, biogas, synthesis gas and ammonia. In other embodiments, it is selected from natural gas (NG), mixtures of NG/$H_2$ and hydrogen.

In preferred embodiments, the main oxidant is air.

Generally herein, the specific nature of the fuels and oxidants to be used with the burner of the present invention is not particularly limited. Moreover, in some embodiments, the material flowing through a particular conduit (e.g., fuel or oxidant) may be replaced with a material that is either the same or different (e.g., oxidant or fuel) from what is disclosed above. For example, a secondary oxidant may be used in lieu of the secondary fuel in the burner (1). In this particular embodiment, a fuel flows through the primary fuel conduit (20) of the burner (1) while an oxidant flows through the main oxidant conduit (30), the secondary fuel conduit (40), and, optionally, the secondary oxidant conduits (50). Alternatively, in some embodiments, a secondary fuel can be used in lieu of the main oxidant. In this embodiment, a fuel flows through the primary fuel conduit (20) and the main oxidant conduit (30) of the burner (1) while an oxidant or fuel flows through the secondary fuel conduits (40) and, optionally, the secondary oxidant conduits (50). In other words, any combination of fuel or oxidant can flow through the primary fuel conduit (20), the main oxidant conduit (30), the secondary fuel conduit (40), and, optionally, the secondary oxidant conduits of the burner (1).

As used herein, an "outlet plane" of a given conduit designates a plane defined in direction perpendicular to the main axis of the conduit at a downstream location where the fuel or oxidant respectively is no longer restricted by two walls.

As used herein, a "conduit end plane" of a given conduit designates a plane defined in direction perpendicular to the main axis of the conduit at the downstream end of the conduit.

In preferred embodiments herein, D3/D2 is from 1.5 to 4.5, in particular from 2.0 to 3.0.

In preferred embodiments herein, D4/D2 is from 3.0 to 9.0, in particular from 3.5 to 5.5.

In preferred embodiments herein, D5/D2 is from 5.0 to 11.0, in particular from 5.5 to 7.0.

In preferred embodiments herein, L1/L4 is from 0.5 to 2.5, in particular from 1.0 to 2.0.

In preferred embodiments herein, L0/D3 is from 0.25 to 1.0, in particular from 0.4 to 0.6.

In preferred embodiments herein, (L1+L2)/D3 is from 0.25 to 1.0, in particular from 0.4 to 0.6.

In preferred embodiments herein, L3/D4 is from 0.05 to 0.25, in particular from 0.1 to 0.2.

In preferred embodiments herein, D6/D2 is from 9.0 to 22.0, in particular from 10.0 to 14.0.

In preferred embodiments herein, D6/D5 is from 1.75 to 2.5, in particular from 1.8 to 2.1.

In preferred embodiments herein, D7/D2 is from 0.15 to 1.0, in particular from 0.25 to 0.75.

In preferred embodiments herein, H/P1 is from 1.25 to 2.5.

In preferred embodiments herein, angle alpha is from 3 to 30, such as from 10 to 20 degrees. The ratio of area of all bleed holes in one row to the surface area of cylinder of height, P1 and inner diameter, D2 is between 10% and 55%

Without intending to be bound by theory, a lower range limit of angle alpha helps to separate the holes such that they are not too close to disturb the intermixing of fuel and air-and a higher range limit of angle alpha prevents the holes from being too far apart and ensures there is enough fluid communication between adjacent jets to enhance mixing and ignition of fuel-air inside the ignition chamber.

Each series may be symmetrically staggered to provide three dimensional mixing effects. This mixing is critical to provide a reliable ignition of the burner at lean equivalence ratio of as small as 0.25.

In preferred embodiments herein, angle beta is from 5 to 40 degrees.

The purge air plate (73) has a porosity (defined by the total open area on the plate that allows the air to flow divided by cross-section area of the plate) in the range of 2% to 15%.

Without intending to be bound by theory, a lower range of angle beta helps to separate the holes such that they are not too close to create air rich regions and a higher range of angle beta prevents the holes from being too far, ensures there is enough fluid communication between adjacent jets to mutually provide chemically active flame radicals that support ignition and thereby enhance flame stability. enough air for fuel-air mixing and create low velocity regions and recirculation zones to provide flame anchoring zone. This flame anchoring location is critical for holding the flame without blow-off, for example under extreme circumstances such as when the primary fuel is reduced to 10% of maximum firing rating of the burner and secondary fuel is cut-off/shut-down.

In some embodiments, the burner comprises different series of holes and consecutive holes in different series of holes are staggered by half the included angle between the two consecutive holes in one series.

In preferred embodiments herein, angle theta is from 10 to 40 degrees.

The primary fuel exit plate (72) has porosity (defined by the total open area on the plate that allows the fuel to flow divided by cross-section area of the plate) in the range of 2% to 25%.

Without intending to be bound by theory, a lower range limit of angle theta helps to separate the holes such that they are not too close to prevent air entrainment in the fuel jet as the two fuel jets get too close—and a higher range of angle theta prevents the holes from being too far and ensures there is enough coupling between two jet development to provide stable flame overall a wide range od turndown and equivance ratio.

In preferred embodiments herein, angle eta is from 10 to 70 degrees, in particular from 40 to 60 degrees.

In some embodiments, the burner comprises different rows of holes and consecutive holes in different series of holes are staggered by half the included angle between the two consecutive holes in one row.

In preferred embodiments, the burner (1) is configured in such a way that the velocity of the primary fuel at the exit of primary fuel exit holes (23) is between 30 ft/s and 500 ft/s, particularly between 40 ft/s and 400 ft/s.

Without intending to be bound by theory, the velocity of primary fuel is determined to significantly contribute to the ability quickly mix the fuel with surrounding air. This velocity range provides a stabile flame without any lift-off.

In preferred embodiments, the burner (1) is configured in such a way that the velocity of the main oxidant at the oxidizer section outlet (34) is between 5 ft/s and 300 ft/s, particularly between 10 ft/s and 200 ft/s.

Without intending to be bound by theory, the maximum attainable main oxidant (preferably air) velocity is typically determined by the available pressure from the air blower. The present inventors found that these velocities along with appropriate swirl angle provides sufficient mixing of the air with the two fuels and maintains a stable flame over a wide range of burner operations even in a cold furnace.

In preferred embodiments, the burner (1) is configured in such a way that the velocity of the secondary fuel is between 20 ft/s and 200 ft/s, particularly between 40 ft/s and 120 ft/s.

Without intending to be bound by theory, the velocity of the secondary fuel is determined such that it provides sufficient mixing with the swirling air thereby enabling a stable flame. Secondary fuel velocity that is below the low velocity limit can result in unreacted fuel collecting near the furnace wall. This fuel can subsequently combust there causing over-heating of the reformer top wall. In preferred embodiments, the burner (1) is configured in such a way that the velocity of the secondary oxidant is between 50 ft/s and 500 ft/s, particularly between 100 ft/s and 300 ft/s.

Without intending to be bound by theory, the velocity of staged oxidizer/secondary oxidant is typically kept high such that the enriched air or oxygen jet would entrain the surrounding combusted gases and lower the local concentration of the oxygen before this high oxygen concentration jets meet the fuel and/or partially combusted fuel/air mixture. This helps in delayed mixing of fuel and oxidizer helping in spacious combustion and lower thermal NOx. The high limit is determined such that the momentum is not high enough that it causes delayed mixing resulting in uncombusted fuel exiting the furnace. This is especially essential if width or length of the furnace is small. Additionally, further increasing the velocity would increase the pressure requirement for the supply. The increased supply pressure would need a secondary compressing device increasing the operating cost of the burner.

In preferred embodiments, the burner of the invention is operated in such a way that i) during start-up, about 100% of the total thermal power (defined as the summation of the product of heating value (higher or lower) and flow rate of each fuel) of the burner is provided by the primary fuel; and/or ii) during normal operation, about 25 to 65%, preferably 45 to 65% of the total heating value of the burner is provided by the primary fuel, and the respective rest is provided by the secondary fuel.

The respective rests are preferably provided by the secondary fuel.

In preferred embodiments, the burner is configured in such a way that i) the volumetric flow rate of the ignition chamber oxidant is about 5 to 25% of the total main oxidant flow rate; and/or ii) the volumetric flow rate of premixed oxidant is about 2 to 10% of the total main oxidant flow rate; and/or iii) the volumetric flow rate of the oxidant diverted to the secondary oxidant conduits (50) is about 2 to 5% of the main oxidant flow rate.

In one particular conduit, the volumetric flow rate of any fluid is divided amongst different outlet by correlating individual exit cross-section area with the total exit cross-sectional area for that conduit. In doing so, the pressure of the fluid and pressure differential between two adjacent conduits are important criteria to determine the directional flow of fluid. For example, FIG. 6B shows a sample area notation for oxidizer conduit. The cross-sectional area of bleed holes (28), air purge holes (32), oxidizer section outlet (34), and premixing holes (27) is A0, A1, A2, and A3.

$$A0 = 5 \text{ to } 25\% \text{ of } (A0 + A1 + A2 + A3)$$

$$A3 = 2 \text{ to } 10\% \text{ of } (A0 + A1 + A2 + A3)$$

Accordingly, in preferred embodiments herein, the cross-sectional area of bleed holes (28), air purge holes (32), oxidizer section outlet (34), and premixing holes (27) is A0, A1, A2, and A3, wherein A0=5 to 25% of (A0+A1+A2+A3).

Likewise, in preferred embodiments herein, the cross-sectional area of bleed holes (28), air purge holes (32), oxidizer section outlet (34), and premixing holes (27) is A0, A1, A2, and A3, wherein A3=2 to 10% of (A0+A1+A2+A3).

Preferably herein, the secondary fuel conduit (40) is in proximity with the main oxidant conduit (30) wherein D5/D4 is preferably between 1.05 and 1.40 and more preferably D5/D4 is between 1.1 and 1.25. This allows to start the flow of secondary fuel and ignition by heat from the primary fuel flame (acts as a pilot flame for the secondary fuel) without the need for furnace being above autoignition temperature of the secondary fuel and/or need of a ignition source to ignite the secondary fuel.

Figure 6A:
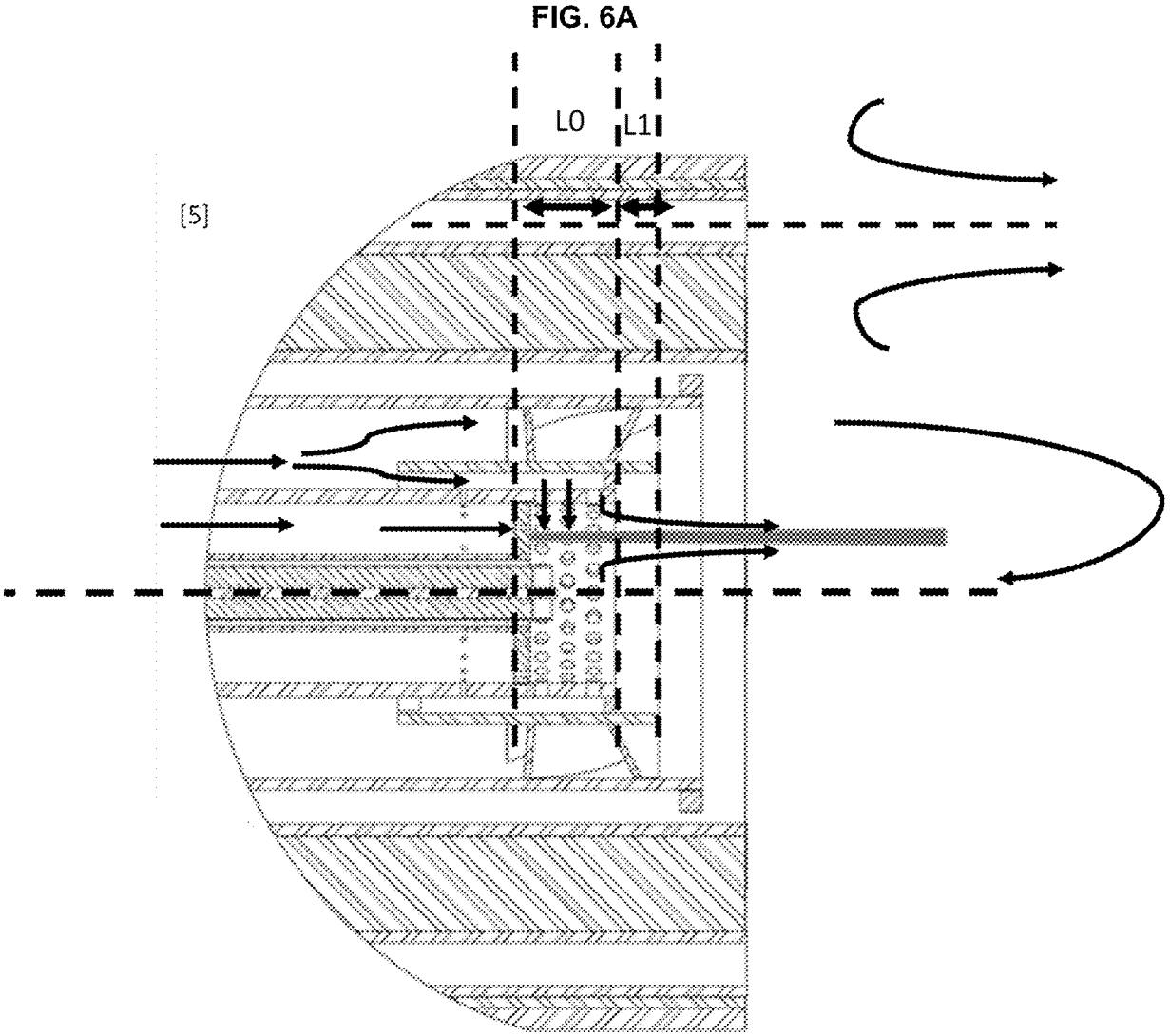
FIG. 6*a* is an exemplary side cross-sectional view of a downstream portion of a burner of the present invention e.g. emphasizing flow and interaction of primary fuel and main oxidant.
Figure 6B:
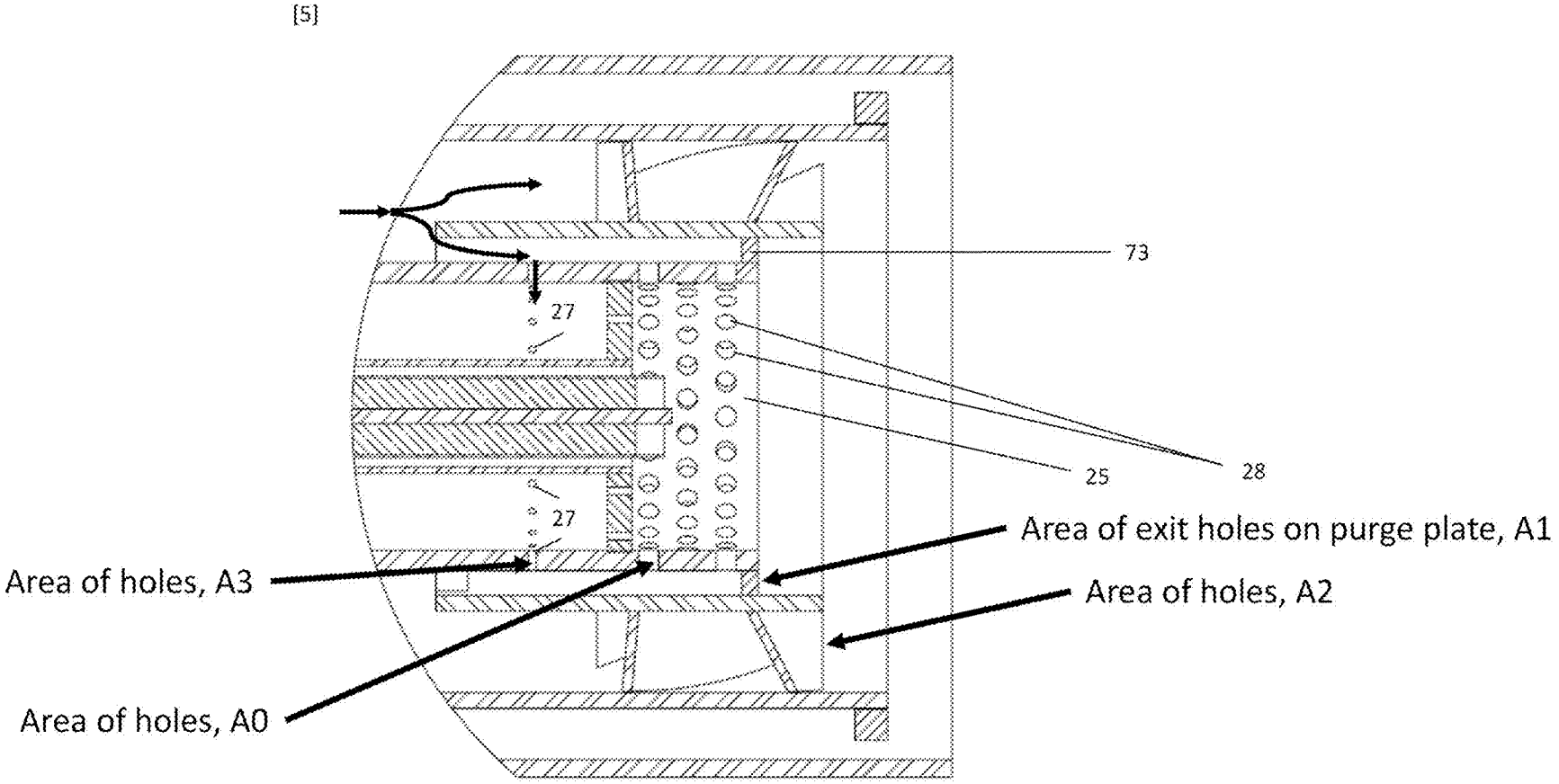
FIG. 6*b* is a corresponding view of an embodiment including partial premixing of the above as an optional feature. The purge holes on wall of Pipe 2 divert a small fraction of the main oxidizer to the primary fuel pipe.

Further particular embodiments of the invention are described in the present Figures, which have been outlined above and which may be described in further detail as follows:

As is e.g. also indicated in FIG. 6*a*, a portion of main oxidizer (typically 2%-40%, preferably 10% to 25%, such as around 20% of the total) is introduced into the ignition chamber enters via the peripheral wall of the chamber, which is at right angles to the fuel distribution nozzle. This serves to vigorously mix the fuel and "ignition" air to enable ignition to reliably and repeatably occur with a gas mixture in the flammable range of fuel concentration, while also enabling peak flame temperatures to be reduced compared with typical diffusion flames. This is regarded important for minimization of flame-generated NOx emissions. Moreover, the method of air introduction also keeps the peripheral wall cooled by protecting it from direct contact with the flame. The fuel distribution plate (72) (which term may be exchangeably used herein with "primary fuel exit plate") is recessed by L0+L1 length in order to give more length for the fuel jets to partially or fully develop and partially-premix with the "ignition cup" air.

In further detail, in preferred embodiments, the distribution plates are recessed by L0+L1+L2 or by L01+L1+L2 length from the hot face of the burner. In more detail, a portion of main oxidant (typically around 20% of the total) is introduced into the 'ignition cup' and 'oxidant bleed cup' enters via the peripheral wall of the chamber, which is at right angles to the fuel distribution nozzle. The first portion that enters the 'ignition cup' vigorously mix with a portion of the fuel and "ignition" oxidant such that the mixture composition in the 'ignition cup' allows to ignite the flame overall a broad range of flow rate of fuel and oxidant. The second portion that enters the 'oxidant bleed cup' mix with the fuel such that peak flame temperatures are reduced compared with typical diffusion flames. This is important for minimization of flame-generated NOx emissions. Moreover, the method of oxidant introduction also keeps the peripheral wall cooled by protecting it from direct contact with the flame. The first portion of fuel in 'ignition cup' mixes with 'ignition oxidant'. The mechanical mixture plate breaks the fuel jets in this first section to mix with the 'ignition oxidant'. The second portion of fuel through jets on plane 2 is recessed by L01+L1 in order to give sufficient length for the fuel jets to fully or partially develop and partially-premix with the "oxidant bleed cup" oxidant. This feature helps to stabilize the flame over a broad range of equivalence ratio.

As is e.g. also indicated in FIG. 6*b* the air premixing holes 27 enable fluid communication between main oxidizer and primary fuel upstream of the fuel distribution plate (72). These holes (numbers and diameter, rows of holes) may be predetermined based on the area ratio of the holes A3 and swirl air exit area, as well as the pressures of air and primary fuel. The pre-calculated ratio is dependent on the amount of air needed in the primary fuel during startup.

Figure 6C:
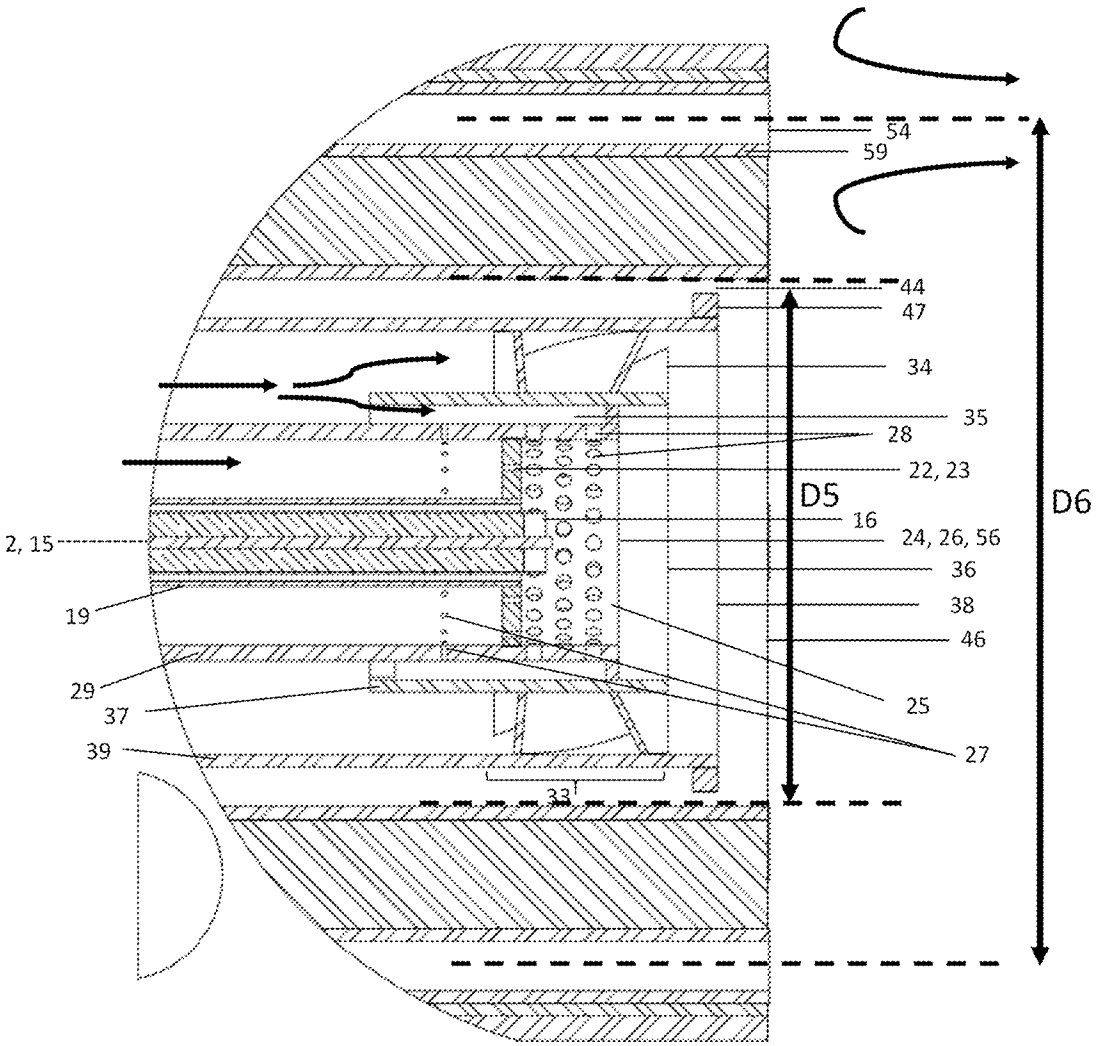
FIG. 6*c* is a related view e.g. emphasizing the interaction of secondary fuel and staged oxidizer.
Figure 7A:
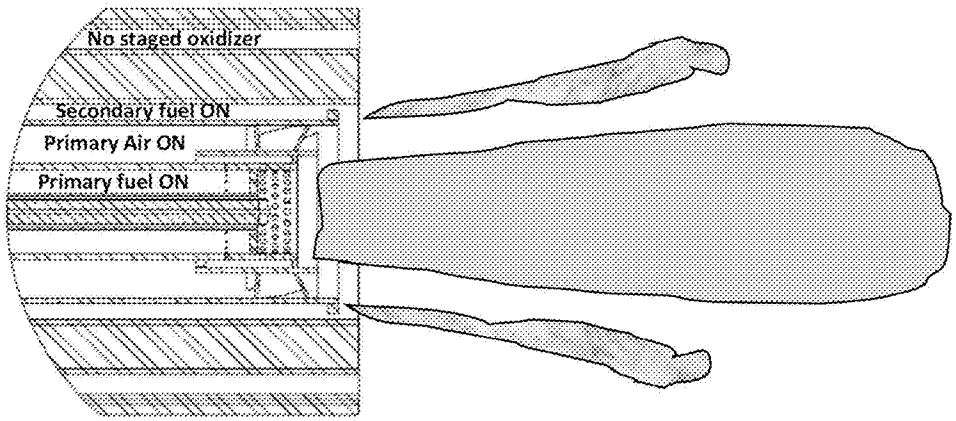
FIGS. 7*a-b* are schematic views of a burner of the invention operating at various steps.
Figure 7A:
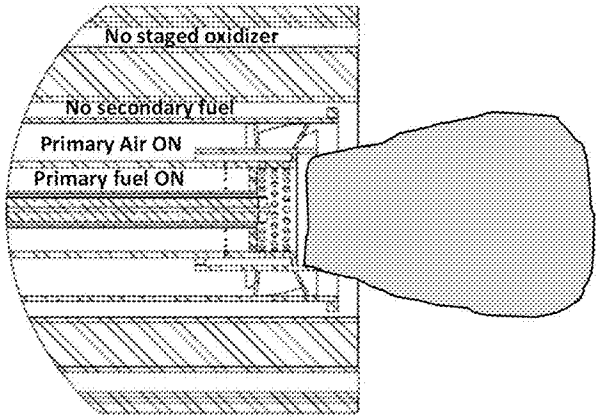
Figure 7B:
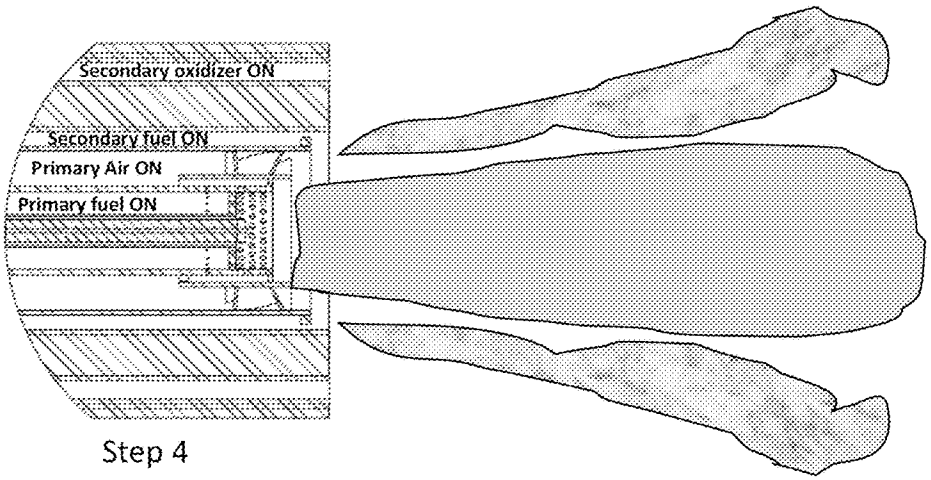
Figure 7B:
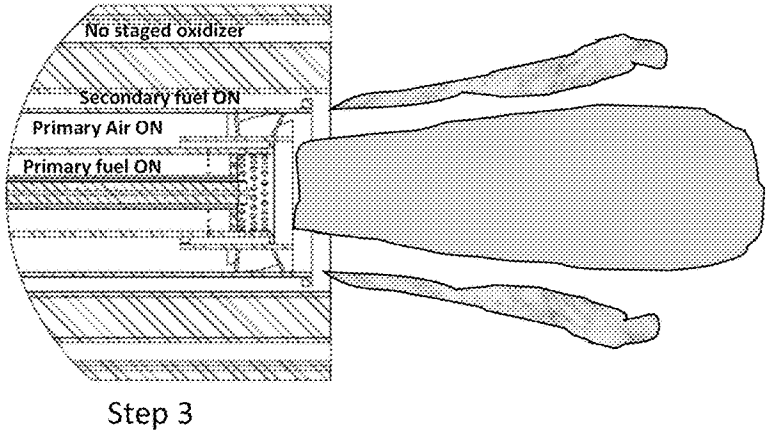

As is e.g. also emphasized in FIG. 6*c* there is an interaction of the secondary fuel and the staged oxidizer and the significance of primary/secondary fuel and oxidizer staging. Primary and Secondary fuels: Apart from helping in lowering NOx emissions. In current design, it also helps to adapt to changing volumetric fuel flow rates when switching between NG and NG/$H_2$ mixtures. Additionally, the 'secondary fuel' helps to create a 'pseudo' isolating blanket between the main oxidizer and staged oxidizer, which can be ~90-100% oxygen purity that potentially helps to reduce contact between $N_2$ present in main oxidizer and the high concentration oxygen jets from the secondary oxidizer jets. Oxidizer staging is regarded important to spatially separate the oxygen/oxygen enriched air ports from the fuel ports as it helps to delay the mixing between fuel and oxidizer and helps in achieving spacious combustion that helps to lower thermal NOx formation. Additionally, the velocity of the staged oxidizer is kept relatively higher to help the oxygen/oxygen enriched air jets to entrain furnace gases that help to lower the local concentration of oxygen that helps in lowering thermal NOx emission.

Generally herein, advantageous characteristics of the present invention include the following, all of which correspond to other preferred embodiments of the first aspect:

- The burner of the first aspect may be characterized in that it is fuel-flexible (and e.g. allows use of NG, $H_2$, NG+$H_2$ mixtures). This burner allows reliable start-up in a cold furnace (below auto-ignition temperature of the fuel) using air-fuel mode.
- The burner of the first aspect may be characterized in that it is operation flexible (and e.g. can work as air-fuel or air-oxy-fuel burner). Hence, the burner can be switched between air-fuel (holding mode) and air-oxy-fuel mode (melting mode) as required by the operational need of e.g. the reheat or secondary melting furnace without any significant changes in the control system of the burner.
- The burner of the first aspect may be characterized in that no water cooling is required.
- The burner of the first aspect may be characterized in that it allows keeping low NOx, e.g. keeping NOx within environmental limits, particularly also by a low NOx design for both air-fuel and air-oxy fuel mode.
- The burner of the first aspect may be characterized in that it allows keeping low CO for both air-fuel and air-oxy fuel mode.
- The burner of the first aspect may be characterized in that a low back pressure of combustion air and oxygen eliminates the need of any secondary compression device.
- The burner of the first aspect may be characterized in that it can operate with air-fuel mode when oxygen is not available irrespective of the average temperature of a furnace.
- The burner of the first aspect may be characterized in that the use of a single fuel, air and secondary oxidant stream to supply the fluids helps to reduce the overall cost of the skids, diverter valves, and/or any complex controller mechanism.
- The burner of the first aspect may be characterized by a turndown ratio of 1:30.
- The burner of the first aspect may be characterized by a fuel lean stable flame without flame blow-off at high excess air (equivalence ratio of as low as 0.25)
- The burner of the first aspect may be characterized in that it enables stable and reliable ignition, and combustion under cold furnace conditions with equivalence ratio as low as 0.25.

In particular embodiments herein, the burner of the first aspect is characterized in that the back pressures of the main oxidizer and the oxygen/oxygen enriched air stream are low such that no secondary compressor device is required to increase the supply pressure.

In a second aspect of the invention, there is provided a furnace comprising a burner according to the first aspect of the invention.

Preferred embodiments of the furnaces of the invention correspond to the embodiments of the burners of the invention described above. Hence, preferably, the furnace is further defined in line with any of the above embodiments of the burner as described in context with the first aspect.

This includes embodiments relating to the above described advantages of the burner of the first aspect, which are also envisaged herein regarding respective furnaces of the second aspect.

In certain preferred embodiments, the furnace is selected from the group consisting of a furnace for steam methane reforming, a reheat furnace in steel industries, and a secondary melting furnace.

In a third aspect of the invention, there is provided a method for operating a burner of the first aspect and/or for operating a furnace of the second aspect.

Said method is not particularly limited as will readily be appreciated by the skilled person.

In certain embodiments, the method comprises the steps of i) starting the burner, ii) ramping up the burner in firing rate, iii) starting the secondary fuel, iv) further ramping up the burner to the firing rate of the burner, and v) optionally supplying the secondary oxidant to the burner.

In particular embodiments of the third aspect, step i) comprises starting the main oxidant, the igniter, and the primary fuel.

Generally, further preferred embodiments of the methods of the invention correspond to the embodiments of the burners of the invention described above, wherein the burner used in the method is further defined by further product features. In other words, preferably, the methods of the invention are further defined in line with any of the above embodiments of the burner as described in context with the first aspect.

Moreover, even further preferred embodiments of the methods of the invention involve further method features that are based on any features described above in context with the burners of the invention.

Moreover, advantages of the present invention include the following, all of which correspond to further preferred embodiments of the third aspect:

- The method of the third aspect may be characterized in that it is fuel-flexible (and e.g. allows use of NG, $H_2$, NG+$H_2$ mixtures). This e.g. allows reliable start-up in a cold furnace using air-fuel mode.
- The method of the third aspect may be characterized in that it is operation flexible (and e.g. can work as air-fuel or air-oxy-fuel burner). Hence, the method can be switched between air-fuel (holding mode) and air-oxy-fuel mode (melting mode) as required by the operational need of e.g. the reheat or secondary melting furnace without any significant change in control system of the burner.

The method of the third aspect may be characterized in that no water cooling is required.

The method of the third aspect may be characterized in that it allows keeping low NOx, e.g. keeping NOx within environmental limits, particularly also for both air-fuel and air-oxy fuel mode.

The method of the third aspect may be characterized in that a low back pressure of combustion air and oxygen eliminates the need of any secondary compression device.

The method of the third aspect may be characterized in that it can be performed with air-fuel mode when oxygen is not available irrespective of the average temperature of a furnace.

The method of the third aspect may be characterized in that the use of a single fuel, air and secondary oxidant stream to supply the fluids helps to reduce the overall cost of the skids, diverter valves, and/or any complex controller mechanism.

Moreover, generally herein, preferred embodiments of any of the second to fourth aspects correspond to preferred embodiments of the first aspect herein.

In general, the articles "a" and "an" as used herein mean one or more when applied to any feature in embodiments of the present invention described in the specification and claims. The use of "a" and "an" does not limit the meaning to a single feature unless such a limit is specifically stated. The article "the" preceding singular or plural nouns or noun phrases denotes a particular specified feature or particular specified features and may have a singular or plural connotation depending upon the context in which it is used. The adjective "any" means one, some, or all indiscriminately of whatever quantity.

Moreover, generally herein, if a certain embodiment is described by using the term "comprising" or suchlike terms, further embodiments are envisaged herein as well, which are described by using the term "consisting of" or suchlike terms instead of the said term "comprising" or suchlike terms.

FURTHER PARTICULAR EMBODIMENTS

The present invention particularly also relates to the following items:

Item 1: A burner (1), comprising a primary fuel conduit (20) comprising a primary fuel outlet (22) having a multiplicity of primary fuel exit holes (23) for supply of a primary fuel into an ignition chamber (25), wherein the wall surrounding the ignition chamber (25) comprises a plurality of bleed holes (28), a main oxidant conduit (30) for supply of a main oxidant, comprising an intermediate annular conduit (35) in a downstream portion (5) of the burner, which intermediate annular conduit (35) is configured to allow splitting of the main oxidant, such that a first portion is introduced into the ignition chamber (25) via the plurality of bleed holes (28) to mix with the primary fuel, and a second portion is optionally introduced into an oxidant section (33), preferably wherein the burner further comprises a plurality of secondary oxidant conduits (50) for supply of a secondary oxidant, particularly wherein at least in said downstream portion (5) of the burner (1) the primary fuel conduit (20) is surrounded by the main oxidant conduit (30) and the plurality of secondary oxidant conduits (50).

Item 2 The burner of item 1, wherein the burner further comprises a secondary fuel conduit (40) for supply of a secondary fuel, having a secondary fuel outlet (44) at its downstream end, wherein at least in the downstream portion (5) of the burner (1), in which primary fuel outlet (22), ignition chamber (25), intermediate annular conduit (35) and secondary fuel outlet (44) are present, the primary fuel conduit (20) is surrounded by the main oxidant conduit (30) and the secondary fuel conduit (40).

Item 3: The burner of item 1 or 2, wherein the burner further comprises a plurality of secondary oxidant conduits (50) for supply of a secondary oxidant, particularly wherein at least in said downstream portion (5) of the burner (1), which further comprises the secondary oxidizer outlet (54), the primary fuel conduit (20) is surrounded by the main oxidant conduit (30) and the secondary fuel conduit (40), and the plurality of secondary oxidant conduits (50).

Item 4: The burner of any of the preceding items, wherein the burner (1) further comprises an ignition source (10), particularly wherein the ignition source (10) terminates in the ignition chamber (25), particularly wherein the ignition source (10) is a central ignition source having a central axis (15) and a conduit end plane (16), especially wherein the main axis (2) of the burner (1) coincides with the central axis (15) of the ignition source (10), in particular wherein at least in said downstream portion (5) of the burner (1) the central ignition source (10) is surrounded by the primary fuel conduit (20), the main oxidant conduit (30) and the secondary fuel conduit (40), and optionally the plurality of secondary oxidant conduits (50).

Item 5: The burner of any of items 1 to 4, wherein the ignition chamber (25) is positioned within the primary fuel conduit (20), and is extending from the primary fuel outlet (22) to the primary fuel conduit end plane (24), wherein the primary fuel conduit wall (29) is surrounding the ignition chamber (25) and comprises a plurality of bleed holes (28).

Figure 9A:
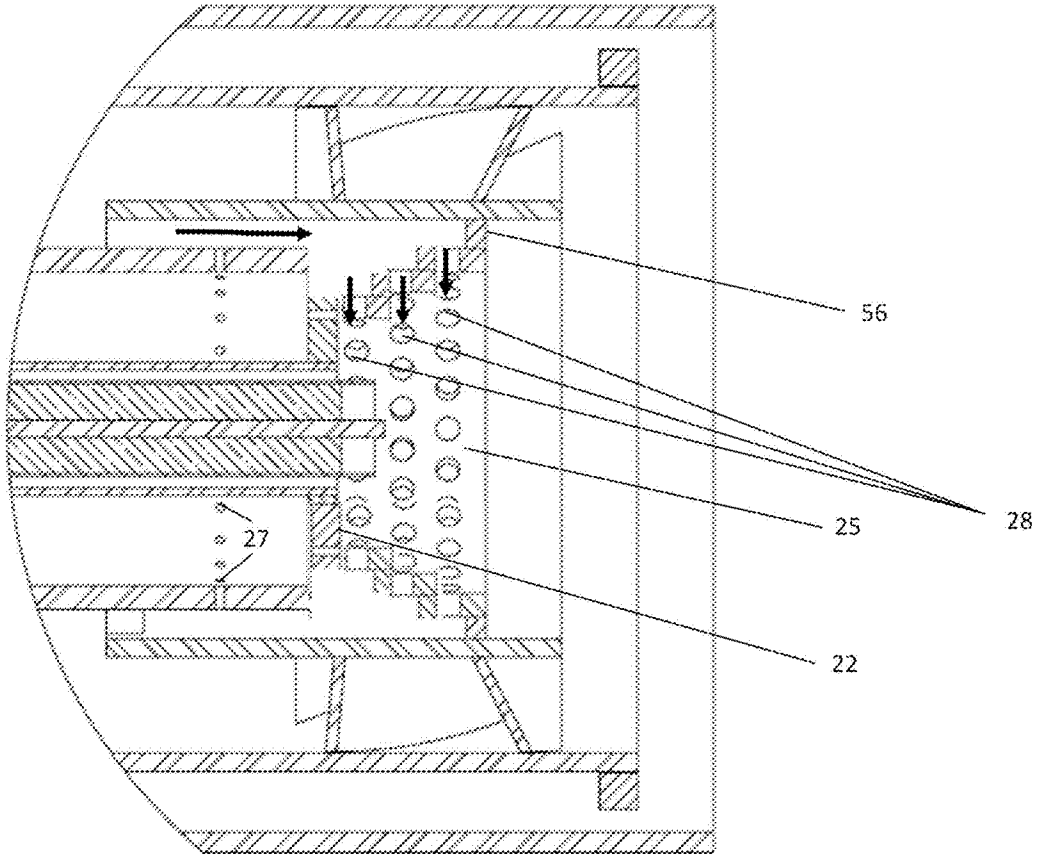
FIGS. 9*a-c* are exemplary cross-sectional views of alternative embodiments of the present invention involving alternative types of (partial) premixing of primary fuel and main oxidant (e.g. air), such as using "step design".

Item 6 (cf. e.g. FIG. 9A): The burner of any of items 1 to 4, wherein the ignition chamber (25) is extending from the primary fuel outlet (22) to the intermediate annular conduit exit plane (56), wherein the wall surrounding the ignition chamber (25) comprises at least two (preferably two or three) steps of annular conduits with increasing diameter, each of which comprises a plurality of bleed holes (28).

Figure 9B:
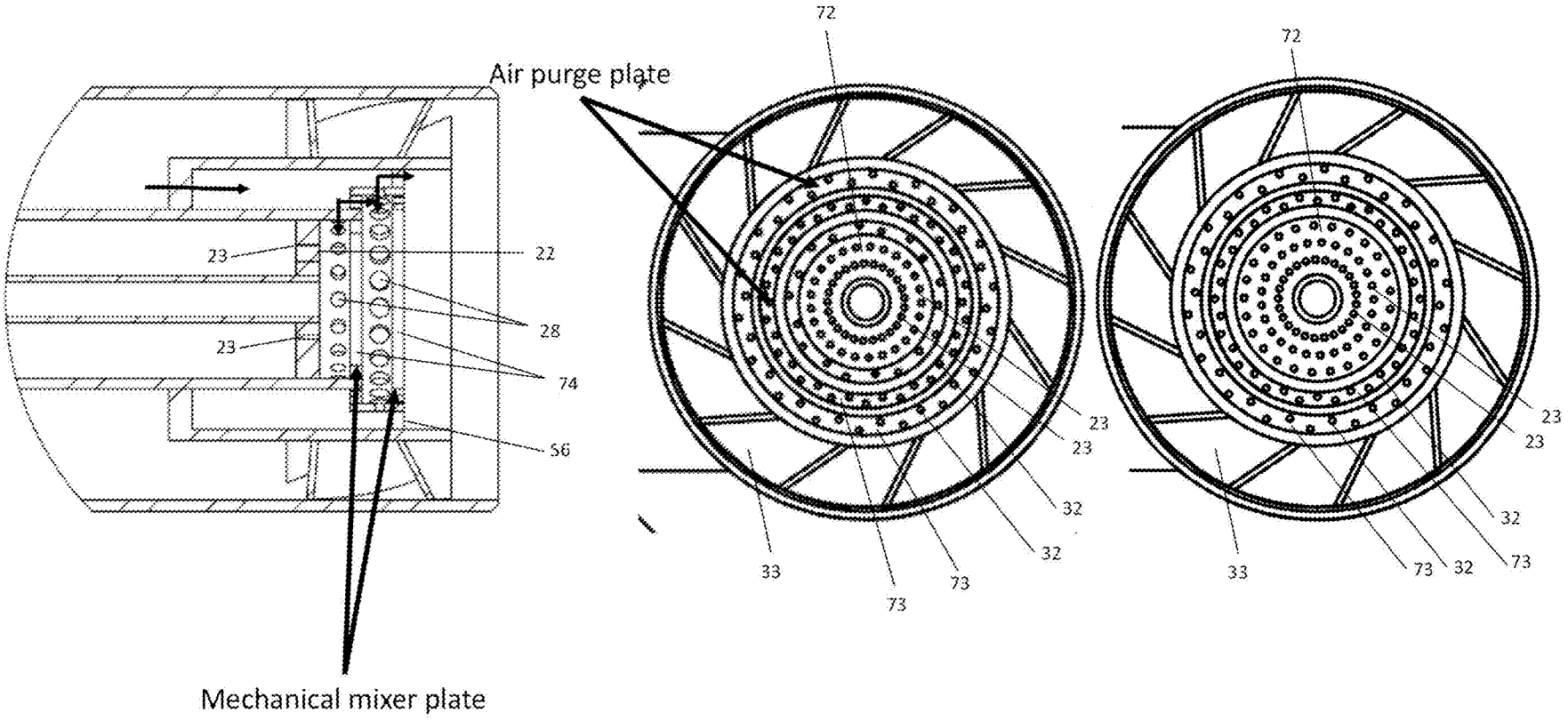

Item 7 (see e.g., FIG. 9B): The burner of any of items 1 to 4, wherein the ignition chamber (25) is extending from the primary fuel outlet (22) to the intermediate annular conduit exit plane (56), wherein the wall surrounding the ignition chamber (25) comprises two sections, wherein i) the first section is extending from the primary fuel outlet (22) to the primary fuel conduit end plane (24), wherein the primary fuel conduit wall (29) surrounding the section comprises a plurality of bleed holes (28), and ii) the second section has an inner diameter greater than the outer diameter of the primary fuel conduit (20), but the second section has an outer diameter smaller than the inner diameter of the intermediate annular conduit (35), and comprises a further plurality of bleed holes (28), optionally wherein the burner further comprises iii) an air purge plate (73) with purge holes (32) that extends between the first section's outer diameter and the inner diameter of the second section, and iv) two mechanical mixer plates (74) each located downstream of and adjacent to the said two sections.

Figure 9C:
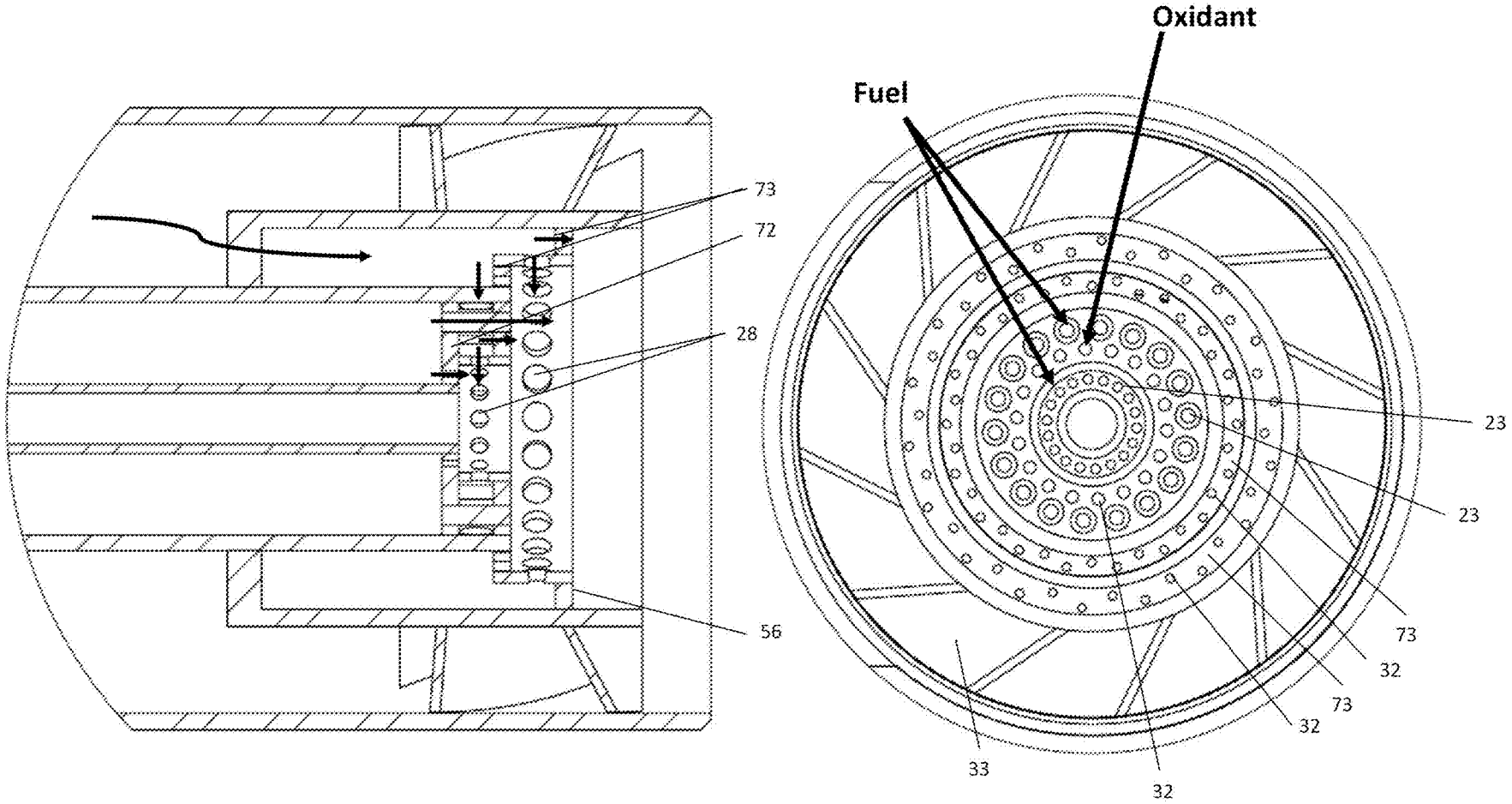
Figure 10:
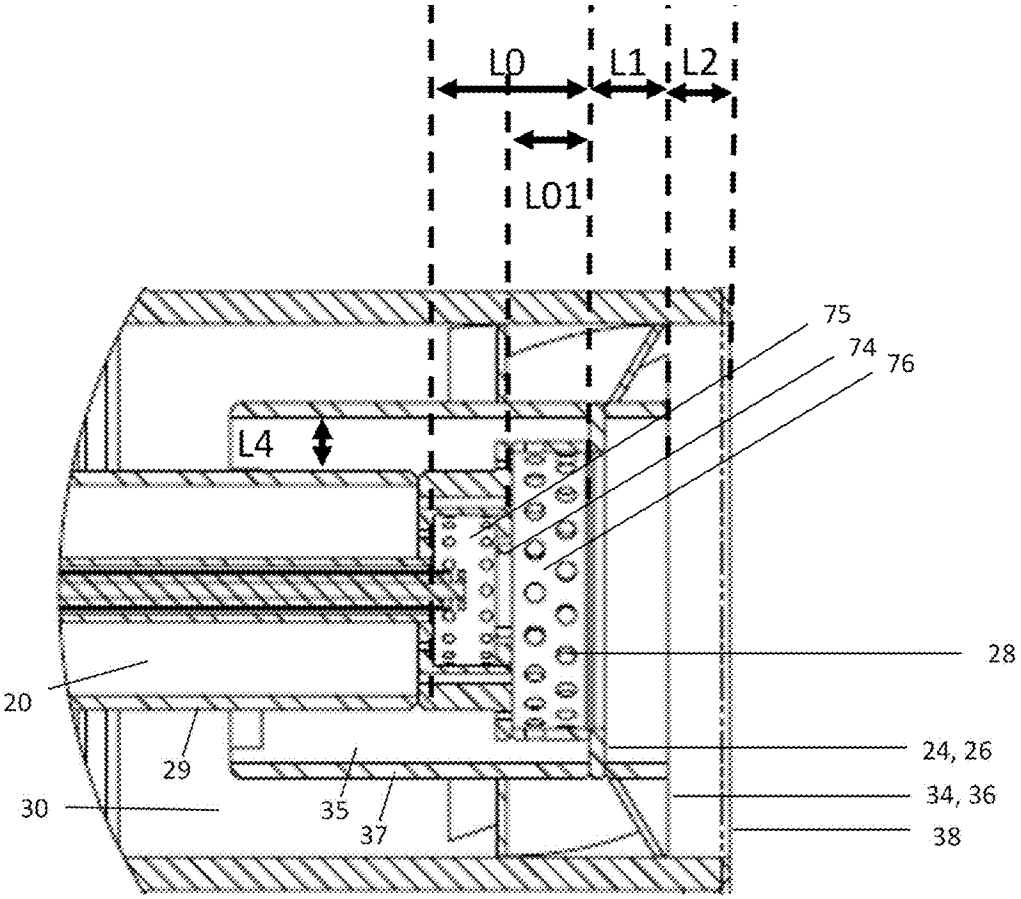
FIG. 10 illustrates an exemplary cross-sectional view of embodiments of the present invention involving an ignition cup (75) and air bleed cup (76), and shows respective distances L0, L01, L1, etc., FIG. 11 further illustrates certain features (such as anchoring points and stabilization surfaces) of a burner of the invention as discussed in present Example 1.

Item 8 (cf. e.g. FIG. 9C): The burner of any of items 1 to 4, wherein the ignition chamber (25) is extending from the primary fuel outlet (22) to the intermediate annular conduit exit plane (56), wherein the wall surrounding the ignition chamber (25) comprises two sections, wherein i) the first section has an outer diameter smaller than the inner diameter of the primary fuel conduit (20) and comprises a plurality of bleed holes (28), wherein the primary fuel conduit wall (29) surrounding the first section comprises a plurality of bleed holes (28), and wherein the first section further comprises means allowing the main oxidant to additionally enter the ignition chamber (25) in flow direction in between two rings of primary fuel exit holes, and ii) the second section has an inner diameter greater than the outer diameter of the primary fuel conduit (20), but the second section has an outer diameter smaller than the inner diameter of the intermediate annular conduit (35), and comprises a further plurality of bleed holes (28).

Item 9: The burner of any one of the preceding items, wherein the ignition chamber (25) comprises an ignition cup (75) as well as an oxidant bleed cup (76), preferably wherein the ignition cup (75) is comprised in a first section of the ignition chamber (25), and the oxidant bleed cup (76) is comprised in a second section of the ignition chamber (25), wherein the second section is located downstream of the first section.

Item 10: The burner of any one of the preceding items, i) the primary fuel conduit end plane (24) corresponds to the ignition chamber end plane (26); and/or ii) the primary fuel conduit further comprises air premixing holes (27) upstream of the primary fuel outlet (22); and/or iii) the main oxidant conduit (30) further comprises purge holes (32) in flow direction parallel to the main axis (2) of the burner; and/or iv) the main oxidant conduit (30) further comprises a swirler section (33), particularly wherein the intermediate annular conduit (35) is configured to allow splitting of the main oxidant into two portions, wherein a second portion is introduced into a swirler section (33); and/or v) the burner (1) further comprises a turbulence generator (47) in the secondary fuel conduit (40).

Item 11: The burner of any one of the preceding items, wherein the primary fuel conduit end plane (24) corresponds to the ignition chamber end plane (26).

Item 12: The burner of any one of the preceding items, wherein the primary fuel conduit further comprises air premixing holes (27) upstream of the primary fuel outlet (22).

Item 13: The burner of any one of the preceding items, wherein the main oxidant conduit (30) further comprises purge holes (32) in flow direction parallel to the main axis (2) of the burner.

Item 14: The burner of any one of the preceding items, wherein the main oxidant conduit (30) further comprises a oxidant section (33) which is a swirler section (33), particularly wherein the intermediate annular conduit (35) is configured to allow splitting of the main oxidant into two portions, wherein a second portion is introduced into a swirler section (33).

Item 15: The burner of any one of the preceding items, wherein the burner (1) further comprises a turbulence generator (47) in the secondary fuel conduit (40), particularly wherein said turbulence generator comprises one or more turbulence generator disc(s).

Item 16: The burner of any one of the preceding items, wherein i) the diameter of the primary fuel exit holes (23) is defined as D0, wherein D0/D2 is between 0.04 and 0.5; and/or ii) the diameter of the purge holes (32) is defined as D1, wherein D1/D2 is between 0.04 and 0.5; and/or iii) the outer diameter of the ignition source (10) is defined as D2 and the inner diameter of the primary fuel conduit (20) is defined as D3, wherein D3/D2 is from 1.5 to 4.5, in particular from 2.0 to 3.0; and/or iv) the outer diameter of the ignition source (10) is defined as D2 and the inner diameter of the main oxidant conduit (30) is defined as D4, wherein D4/D2 is from 3.0 to 9.0, in particular from 3.5 to 5.5; and/or v) the outer diameter of the ignition source (10) is defined as D2 and the inner diameter of the secondary fuel conduit (40) is defined as D5, wherein D5/D2 is from 5.0 to 11.0, in particular from 5.5 to 7.0; and/or vi) the outer diameter of the ignition source (10) is defined as D2 and the distance between the centers of two secondary oxidant conduits (50) located opposite from each other in relation to the main axis (2) of the burner is defined as D6, wherein D6/D2 is from 9.0 to 22.0, in particular from 10.0 to 14.0; and/or vii) the inner diameter of the secondary fuel conduit (40) is defined as D5 and the distance between the centers of two secondary oxidant conduits (50) located opposite from each other in relation to the main axis (2) of the burner is defined as D6, wherein D6/D5 is from 1.75 to 2.5, in particular from 1.8 to 2.1; and/or viii) the diameter of the air premixing holes (27) is defined as P0, wherein P0/D2 is between 0.02 and 0.2; and/or ix) the inner diameter of the bleed holes (28) is defined as P1; wherein P1/D2 is between 0.05 and 0.4; and/or x) the distance between the primary fuel conduit end plane (24) and the intermediate annular conduit end plane (36) is defined as L1 and the distance between the primary fuel conduit wall (29) and the intermediate annular conduit wall (37) is defined as L4, wherein L1/L4 is from 0.5 to 2.5, in particular from 1.0 to 2.0; and/or xi) the distance between the primary fuel conduit end plane (24) and the intermediate annular conduit end plane (36) is defined as L1, the distance between the intermediate annular conduit end plane (36) and the main oxidant conduit end plane (38) is defined as L2 and the inner diameter of the primary fuel conduit (20) is defined as D3, wherein (L1+L2)/D3 is from 0.25 to 1.0, in particular from 0.4 to 0.6; and/or xii) the distance between the main oxidant conduit end plane (38) and the secondary fuel conduit end plane (46) is defined as L3, and the inner diameter of the main oxidant conduit (30) is defined as D4, wherein L3/D4 is from 0.05 to 0.25, in particular from 0.1 to 0.2; and/or xiii) wherein the distance between the primary fuel outlet (22) and the primary fuel conduit end plane (24) and/or ignition chamber end plane (26) is defined as L0 and the inner diameter of the primary fuel conduit (20) is defined as D3, wherein L0/D3 is from 0.25 to 1.0, in particular from 0.4 to 0.6; and/or xiv) the distance between two rows of bleed holes (28) measured between their centers is defined as H and the inner diameter of the bleed holes (28) is defined as P1, wherein H/P1 is from 1.25 to 2.5; and/or XV) the angle defined by the main axis (2) of the burner and the centers of two adjacent bleed holes (28) is defined as angle alpha, wherein angle alpha is from 3 to 30 degrees; and/or xvi) the angle defined by the main axis (2) of the burner and the centers of two adjacent purge holes (32) is defined as angle beta, wherein angle beta is from 5 to 40 degrees; and/or xvii) the angle defined by the main axis (2) of the burner and the centers of two adjacent primary fuel exit holes (23) is defined as angle theta, wherein angle theta is from 10 to 40 degrees; and/or xviii) the angle defined by the main axis (2) of the burner and the centers of two adjacent secondary oxidant conduits (50) is defined as angle eta, wherein angle eta is from 10 to 70 degrees, in particular from 40 to 60 degrees.

Item 17: The burner of any one of the preceding items, wherein the diameter of the primary fuel exit holes (23) is defined as D0/D2, wherein D0 is between 0.04 and 0.5.

Item 18: The burner of any one of the preceding items, wherein the diameter of the purge holes (32) is defined as D1, wherein D1/D2 is between 0.04 and 0.5.

Item 19: The burner of any one of the preceding items, wherein the outer diameter of the ignition source (10) is defined as D2, and the inner diameter of the primary fuel conduit (20) is defined as D3, wherein D3/D2 is from 1.5 to 4.5, in particular from 2.0 to 3.0.

Item 20: The burner of any one of the preceding items, wherein the outer diameter of the ignition source (10) is defined as D2, and the inner diameter of the main oxidant conduit (30) is defined as D4, wherein D4/D2 is from 3.0 to 9.0, in particular from 3.5 to 5.5.

Item 21: The burner of any one of the preceding items, wherein the outer diameter of the ignition source (10) is defined as D2, and the inner diameter of the secondary fuel conduit (40) is defined as D5, wherein D5/D2 is from 5.0 to 11.0, in particular from 5.5 to 7.0.

Item 22: The burner of any one of the preceding items, wherein the outer diameter of the ignition source (10) is defined as D2, and the distance between the centers of two secondary oxidant conduits (50) located opposite from each other in relation to the main axis (2) of the burner is defined as D6, wherein D6/D2 is from 9.0 to 22.0, in particular from 10.0 to 14.0.

Item 23: The burner of any one of the preceding items, wherein the inner diameter of the secondary fuel conduit (40) is defined as D5, and the distance between the centers of two secondary oxidant conduits (50) located opposite from each other in relation to the main axis (2) of the burner is defined as D6, wherein D6/D5 is from 1.75 to 2.5, in particular from 1.8 to 2.1.

Item 24: The burner of any one of the preceding items, wherein the diameter of the air premixing holes (27) is defined as P0, wherein P0/D2 is between 0.02 and 0.2.

Item 25: The burner of any one of the preceding items, wherein the inner diameter of the bleed holes (28) is defined as P1, wherein P1/D2 is between 0.05 and 0.4.

Item 26: The burner of any one of the preceding items, wherein the distance between the primary fuel conduit end plane (24) and the intermediate annular conduit end plane (36) is defined as L1, and the distance between the primary fuel conduit wall (29) and the intermediate annular conduit wall (37) is defined as L4, wherein L1/L4 is from 0.5 to 2.5, in particular from 1.0 to 2.0.

Item 27: The burner of any one of the preceding items, wherein the distance between the primary fuel conduit end plane (24) and the intermediate annular conduit end plane (36) is defined as L1, the distance between the intermediate annular conduit end plane (36) and the main oxidant conduit end plane (38) is defined as L2, and the inner diameter of the primary fuel conduit (20) is defined as D3, wherein (L1+L2)/D3 is from 0.25 to 1.0, in particular from 0.4 to 0.6.

Item 28: The burner of any one of the preceding items, wherein the distance between the main oxidant conduit end plane (38), and the secondary fuel conduit end plane (46) is defined as L3, and the inner diameter of the main oxidant conduit (30) is defined as D4, wherein L3/D4 is from 0.05 to 0.25, in particular from 0.1 to 0.2.

Item 29: The burner of any one of the preceding items, wherein the distance between the primary fuel outlet (22), and the primary fuel conduit end plane (24) and/or ignition chamber end plane (26) is defined as L0 and the inner diameter of the primary fuel conduit (20) is defined as D3, wherein L0/D3 is from 0.25 to 1.0, in particular from 0.4 to 0.6.

Item 30: The burner of any one of the preceding items, wherein the distance between two rows of bleed holes (28) measured between their centers is defined as H and the inner diameter of the bleed holes (28) is defined as P1, wherein H/P1 is from 1.25 to 2.5.

Item 31: The burner of any one of the preceding items, wherein the angle defined by the main axis (2) of the burner and the centers of two adjacent bleed holes (28) is defined as angle alpha, wherein angle alpha is from 3 to 30 degrees.

Item 32: The burner of any one of the preceding items, wherein the angle defined by the main axis (2) of the burner and the centers of two adjacent purge holes (32) is defined as angle beta, wherein angle beta is from 5 to 40 degrees.

Item 33: The burner of any one of the preceding items, wherein the angle defined by the main axis (2) of the burner and the centers of two adjacent primary fuel exit holes (23) is defined as angle theta, wherein angle theta is from 10 to 40 degrees.

Item 34: The burner of any one of the preceding items, wherein the angle defined by the main axis (2) of the burner and the centers of two adjacent secondary oxidant conduits (50) is defined as angle eta, wherein angle eta is from 10 to 70 degrees, in particular from 40 to 60 degrees.

Item 35: The burner of any one of the preceding items 17 to 34, wherein i) D3/D2 is from 1.5 to 4.5, in particular from 2.0 to 3.0; and/or ii) D4/D2 is from 3.0 to 9.0, in particular from 3.5 to 5.5; and/or iii) D5/D2 is from 5.0 to 11.0, in particular from 5.5 to 7.0; and/or iv) D6/D2 is from 9.0 to 22.0, in particular from 10.0 to 14.0; and/or v) D6/D5 is from 1.75 to 2.5, in particular from 1.8 to 2.1.

Item 36: The burner of any one of the preceding items 11 to 29, wherein i) L1/L4 is from 0.5 to 2.5, in particular from 1.0 to 2.0; and/or ii) L0/D3 is from 0.25 to 1.0, in particular from 0.4 to 0.6; and/or iii) (L1+L2)/D3 is from 0.25 to 1.0, in particular from 0.4 to 0.6; and/or iv) L3/D4 is from 0.05 to 0.25, in particular from 0.1 to 0.2; and/or v) H/P1 is from 1.25 to 2.5.

Item 37: The burner of any one of the preceding items 17 to 36, wherein i) angle alpha is from 3 to 30 degrees; and/or ii) angle beta is from 5 to 40 degrees; and/or iii) angle theta is from 10 to 40 degrees; and/or iv) angle eta is from 10 to 70 degrees, in particular from 40 to 60 degrees.

Item 38: The burner of any one of the preceding items, wherein the burner (1) is configured in such a way that—at the exit of a given conduit— i) the velocity of the primary fuel (preferably at the exit of the holes 23) is between 30 ft/s and 500 ft/s, particularly between 40 ft/s and 400 ft/s; and/or ii) the velocity of the main oxidant is between 5 ft/s and 300 ft/s, particularly between 10 ft/s and 200 ft/s; and/or iii) the velocity of the secondary fuel is between 20 ft/s and 200 ft/s, particularly between 40 ft/s and 120 ft/s; and/or iv) optionally the velocity of the secondary oxidant is between 50 ft/s and 500 ft/s, particularly between 100 ft/s and 300 ft/s.

Item 39: The burner of any one of the preceding items, wherein the velocity of the primary fuel is between 30 ft/s and 500 ft/s, particularly between 40 ft/s and 400 ft/s.

Item 40: The burner of any one of the preceding items, wherein the velocity of the main oxidant is between 5 ft/s and 300 ft/s, particularly between 10 ft/s and 200 ft/s.

Item 41: The burner of any one of the preceding items, wherein the velocity of the secondary fuel is between 20 ft/s and 200 ft/s, particularly between 40 ft/s and 120 ft/s.

Item 42: The burner of any one of the preceding items, wherein the velocity of the secondary oxidant is between 50 ft/s and 500 ft/s, particularly between 100 ft/s and 300 ft/s.

Item 43: The burner of any one of the preceding items, wherein the swirl angle is from 5 to 60 degrees, preferably from 30 to 45 degrees.

Item 44: The burner of any one of the preceding items, wherein the burner (1) is configured in such a way that i) during start-up, about 100% of the total thermal power of the burner is provided by the primary fuel; and/or ii) during normal operation, about 25 to 65%, preferably 45 to 65% of the total heating value of the burner is provided by the primary fuel, and the respective rest is provided by the secondary fuel.

Item 45: The burner of any one of the preceding items, wherein the burner (1) is configured in such a way that during start-up, about 100% of the total thermal power of the burner is provided by the primary fuel.

Item 46: The burner of any one of the preceding items, wherein the burner (1) is configured in such a way that during normal operation, about 25 to 65%, preferably 45 to 65% of the total thermal power of the burner is provided by the primary fuel.

Item 47: The burner of any one of items 45 and 46, wherein the respective rest is provided by the secondary fuel Item 48: The burner of any one of the preceding items, wherein the burner (1) is configured in such a way that i) the volumetric flow rate of the ignition chamber oxidant is about 5 to 25% of the total main oxidant flow rate; and/or ii) the volumetric flow rate of premixed oxidant is about 2 to 10% of the total main oxidant flow rate; and/or iii) the volumetric flow rate of the secondary oxidant diverted to the secondary oxidant conduits (50) is about 2 to 5% of the main oxidant flow rate.

Item 49: The burner of any one of the preceding items, wherein the burner (1) is configured in such a way that the volumetric flow rate of the ignition chamber oxidant is about 5 to 25% of the total main oxidant flow rate.

Item 50: The burner of any one of the preceding items, wherein the burner (1) is configured in such a way that the volumetric flow rate of premixed oxidant is about 2 to 10% of the total main oxidant flow rate.

Item 51: The burner of any one of the preceding items, wherein the burner (1) is configured in such a way that the volumetric flow rate of the secondary oxidant diverted to the secondary oxidant conduits (50) is about 2 to 5% of the main oxidant flow rate.

Item 52: The burner of any one of the preceding items, wherein the burner (1) is configured in such a way that, during normal operation, the burner can be turned down from 100% design firing rate to about 1:30 turndown, depending on the operation requirements.

Item 53: The burner (1) of any one of the preceding items, wherein the central ignition source (10) forms "pipe 1" of the burner.

Item 54 The burner (1) of any one of the preceding items, wherein the primary fuel conduit (20) forms "pipe 2" of the burner.

Item 55: The burner (1) of any one of the preceding items, wherein the main oxidant conduit (30) forms "pipe 3" of the burner, which particularly is an air pipe.

Item 56: The burner (1) of any one of the preceding items, wherein the secondary fuel conduit (40) forms "pipe 4" of the burner.

Item 57: The burner (1) of any one of the preceding items, wherein the secondary oxidant conduit (50) is designated as a "staged oxidizer conduit" or "staged oxidizer", respectively.

Item 58: The burner (1) of any one of the preceding items, wherein all of the said conduits except the secondary oxidant conduits (50) share a common central axis.

Item 59: The burner (1) of any one of the preceding items, wherein all of the said conduits except the secondary oxidant conduits (50) are concentrically disposed around a common longitudinal axis at least in the said downstream portion (5).

Item 60: The burner (1) of any one of the preceding items, wherein all of the conduits are essentially straight.

Item 61: The burner (1) of any one of the preceding items, wherein the burner (1) comprises a configuration as essentially depicted in any of the attached Figures or any combination thereof.

Item 62: A furnace comprising a burner (1) according to any one of items 1 to 61.

Item 63: The furnace of item 62, wherein the furnace is selected from the group consisting of a furnace for steam methane reforming, a reheat furnace in steel industry, and a secondary melting furnace.

Item 64: The furnace of item 63, wherein the furnace is further characterized by any features described in any of items 1 to 61.

Item 65: A method for operating a burner (1) in accordance with any one of items 1 to 61, or for operating a furnace in accordance with any one of items 62 to 64, the method comprising the steps of i) starting the burner, ii) optionally ramping up the burner in firing rate, iii) starting the secondary fuel, iv) ramping up the burner to the firing rate of the burner, v) optionally supplying the secondary oxidant to the burner.

Item 66: The method of item 65, wherein step i) comprises starting the main oxidant, the igniter, and the primary fuel.

EXAMPLES

The following examples are used to further illustrate aspects of the invention, but are by no means intended to be limiting in any way.

Example 1

A test burner was manufactured and tested in our industrial scale combustion lab at 5 MMBtu/hr with NG as primary and secondary fuels, air as main oxidant, and oxygen as the secondary oxidant.

The burner was successfully tested for start-up, ramp-up and air-fuel as well air-oxy fuel mode. The burner performed well and showed the burner can produce stable flame under both air-fuel and air-oxy fuel mode without any external support.

Figure 8:
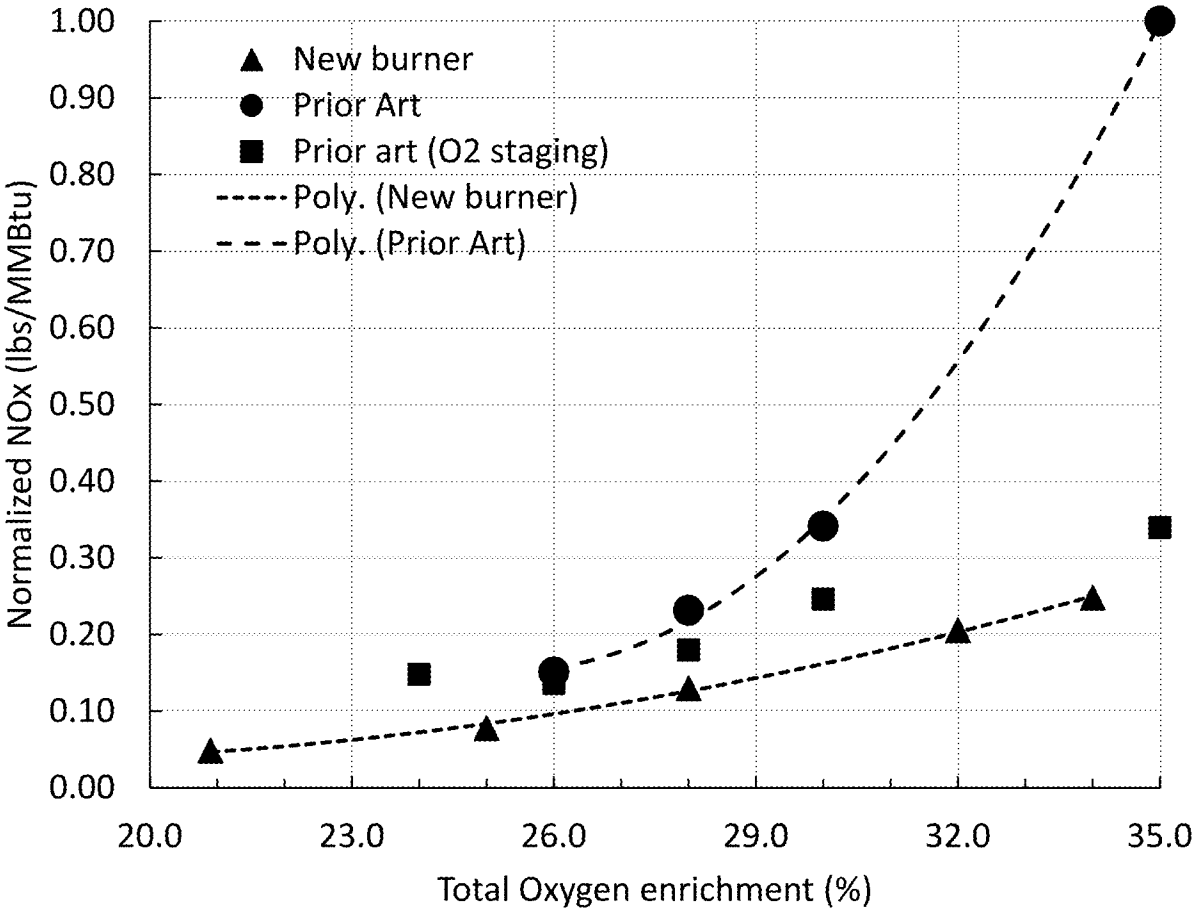
FIG. 8 shows a comparison of experimental results (normalized NOx data) obtained with an exemplary burner of the invention and prior art.
Figure 12:
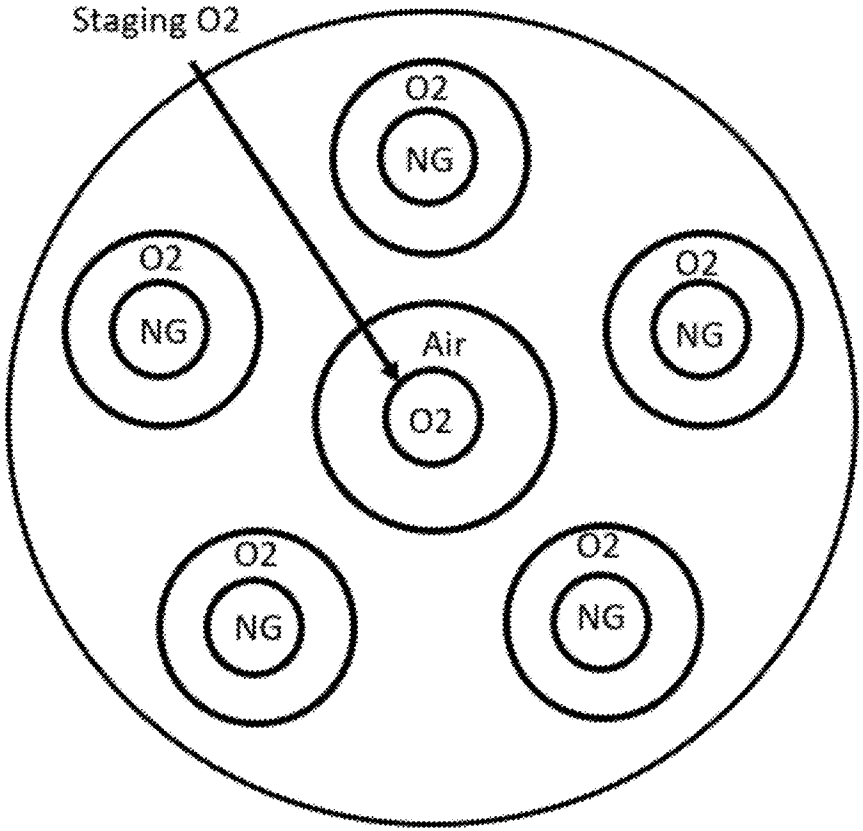
FIG. 12 illustrates a further burner design referred to in the present Example.

The plot in FIG. 8 shows a comparison of the normalized NOx data from the lab testing of the present invention and prior art (FIG. 12). The normalized NOx value is defined as the ratio of NOx (ppm) produced by a burner type by the maximum NOx (ppm) produced from amongst the different burners. Here in the present example, the NOx data has been normalized by the NOx produced by prior art as it produced the maximum NOx (ppm). The total burner firing rate, burner equivalence ratio, and composition of the fuels are same for both the burners.

The result show that the NOx emission from the present invention is about 30% to 70% (depending on the oxygen enrichment level of the burner) lower as compared to the prior art (without oxygen staging and with 75% oxygen staging). The CO emissions under these test conditions stayed less than 20 ppm in the exhaust flue.

The fact that the present invention is able to produce significantly lower NOx on both air-fuel and air-oxy-fuel mode is due to multiple unique features of this burner.

In air-fuel mode, the burner provides improved performance on NOx emissions because the bleed holes (28) provides air in the ignition cup that can be entrained by the fuel jets before the fuel leaves the exit plane of the burner. This enhanced mixing through a unique burner cup tip (ignition chamber) design thereby allows reducing peak temperatures relative to common characteristics of non-premixed burners. The lower peak temperature for this burner flame mimics that of a partially-premixed air-fuel combustion rather than non-premixed combustion.

In the air-oxy-fuel mode, the burner developed stable flame while producing lower NOx as compared to the prior art.

The three fluids: air, fuel and oxygen/oxygen enriched air are supplied through different outlets/ports that are separated spatially thereby reducing the interaction of O2, N2 and high temperatures simultaneously at a local level. First, in the center region of the burner, the air-fuel flame operates in a fuel rich environment that enables to reduce the peak temperatures as compared to stoichiometric combustion (equivalence ratio=1). Second, the bleed holes (28) provides air in the ignition cup that can be entrained by the fuel jets before the fuel leaves the exit plane of the burner. As discussed above, this enhanced mixing through a unique burner cup tip (ignition chamber) design allows reducing peak temperatures relative to non-premixed burners. The lower peak temperatures help to lower the thermal NOx formation.

In addition to this, the radial separated location of the oxygen injection nozzles from the center flame is important to minimize thermal NOx formation. First, the radial separation of the oxidant jets from the secondary fuel exit enables delayed mixing of center fuel flame and the secondary oxidant that enables distribution combustion. Thermal NOx formation is primarily influenced by temperature, nitrogen concentration, and oxygen concentration. The delayed mixing enables distributed combustion that lowers the peak combustion temperatures. Furthermore, the feature of entraining furnace gases to dilute the secondary oxidant stream helps to reduce the local oxygen concentration before these high oxygen concentration jets meet the fuel and/or partially combusted fuel/air mixture. Therefore, the tendency of the burner to form thermal NOx is reduced.

Lastly, the turbulence induced injection of secondary fuel between the main oxidizer (air) and the secondary oxidizer allows to create a 'pseudo' isolating blanket (close to the burner exit) of partially combused fuel between the main oxidizer and staged oxidizer that potentially helps to reduce, in high temperature atmosphere, contact between N2 present in the main oxidizer and the high concentration O2 jets from the secondary oxidizer jets.

Figure 11:
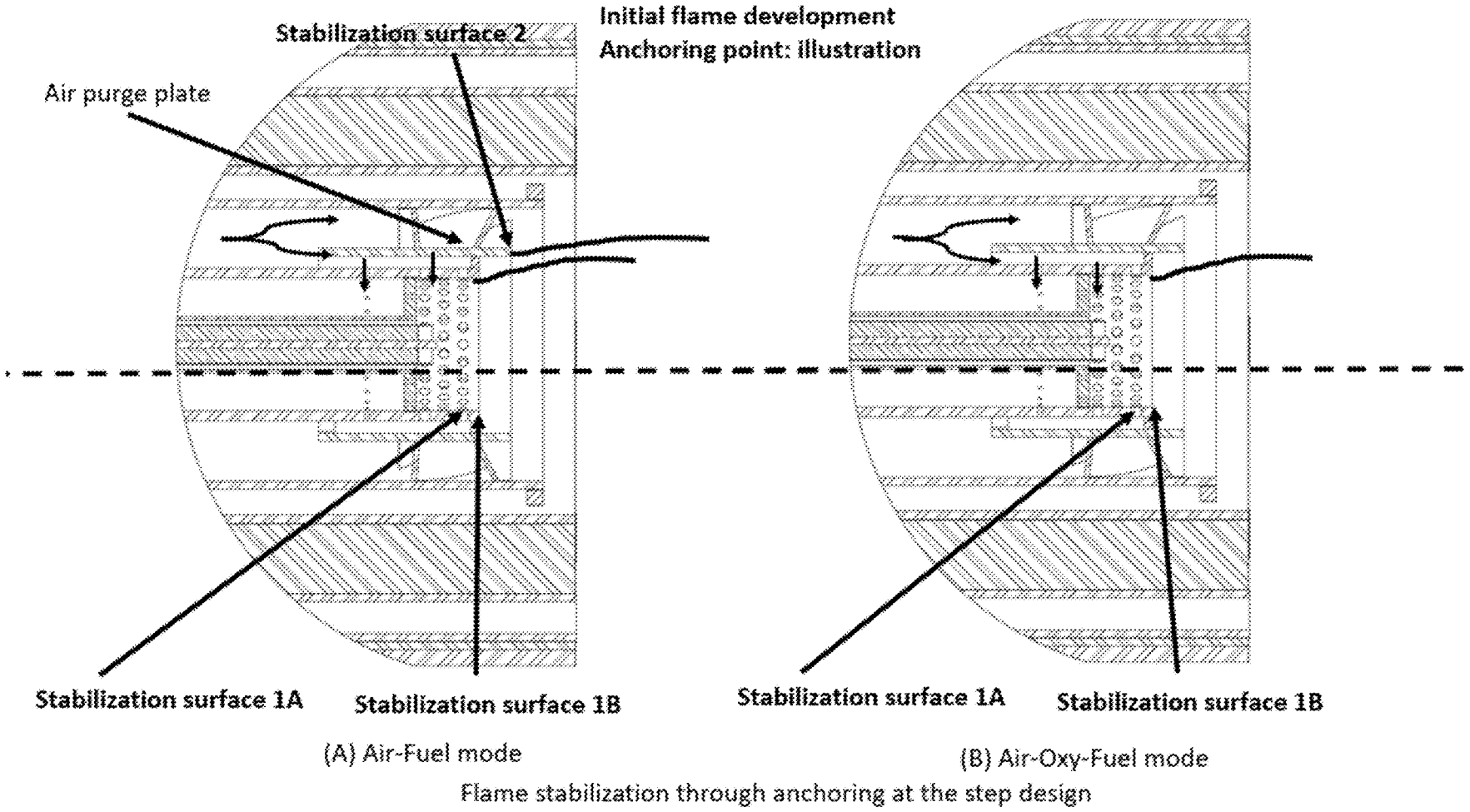

In air-fuel mode, the burner is able to produce stable flame at high turndown of 1:30 and at equivalence ratio of 0.25. This performance is because of the unique configuration of burner hardware that includes the location of air purge plate (73), step design aspect of it, and allowing the air to flow axially through the air purge plate (73) that provides a robust flame anchoring location. The burner provides multiple flame anchoring location based on the total firing rate of the burner as illustrated in FIG. 11. In air-fuel mode, the flame is anchored at two locations: one near the air purge plate (73) and second on the periphery inside wall of the swirler exit plane. In air-oxy-fuel mode (higher oxygen enrichment levels) and in air-fuel mode under turndown conditions and low equivalence ratio, the flame continues to anchor at the air purge plate (73) location without any blow-off because of recirculation zone setup in the area created by step design of the air purge plate (73). Furthermore, the air purge plate (73) is recessed by L1 from the swirler exit plane (34) that allows the flame anchoring to relatively be unaffected by the furnace atmosphere.

The design features of the burner allows oxidizer to be radially and axially purged in the ignition cup that keeps the peripheral wall cooled by protecting it from direct contact with the flame.

The robust flame anchoring mechanism of this burner described above provide additional benefits for burner operation to operate from air-fuel to air-oxy-fuel mode without any burner modification. The stable anchoring position allows more proportion of the oxygen to be supplied by the secondary oxidizer while maintain a stable flame at the center without lift-off. The oxygen supplied by the secondary oxidizer could be as much as 90% of the total oxygen required for the stochiometric combustion of the fuel. If the furnace is above auto-ignition temperature of the fuel and if required, the burner can be operated in full oxy-fuel mode.

In this invention, the two fuel supply conduits with unique injection techniques (one conduit has multiple fuel jets and second conduit has turbulence generator tip) and ignition cup features discussed above) that develops robust flame anchoring provide fuel-flexibility to the burner. For the same thermal input of the burner, as the hydrogen fraction of the fuel is increased in the natural gas, the fuel velocity increases due to higher hydrogen (heating value of hydrogen ~330 Btu/scf) volumetric flow rate required to match the thermal input of NG (heating value of NG ~1000 Btu/scf). This increased velocity can cause the flame to lift-off or impact the heat release rate of the burner. In the new burner, the flame anchoring location helps develop a stable flame at the center. This stable flame at the center acts as a pilot flame to the fuel supplied by the secondary fuel conduit. As a result, the current burner can produce stable flame with NG and/or NG/H2 mixtures.

Finally, the burner ignites well at equivalence ratio as low as 0.25. This allows to start/ignite the burner at low equivalence ratio (fuel lean start-ups). This is possible because of unique design of ignition cup that provides a zone where the ignition can be initiated and sustained while still below the global burner lower flamibility limit of Natural gas. A portion of main oxidizer is introduced into the ignition chamber enters via the peripheral wall of the chamber, which is at right angles to the fuel distribution nozzle. This serves to vigorously mix the fuel and "ignition" air to enable ignition to reliably and repeatably occur a gas mixture having in the flammable range of fuel concentration.

Example 2

In the following example, a non-limiting exemplary detailed method of operating a burner (1) of the invention in accordance with the present invention is described, as also depicted in FIG. 7:

Step 1: Start the main oxidizer (this will also allow some air to come through the cup), start the igniter located at the center of the burner, and start the primary fuel. This lights the primary flame Step 2: Once the flame is lighted, the burner is ramped in firing rate up to a certain rate of MMBtu/hr. At this point, the secondary fuel is started. Since the secondary fuel exit port is located close to the primary fuel flame, the secondary fuel is ignited from the energy supplied by combustion of the primary fuel.

Step 3: The burner is ramped in firing rate to bring it to the firing rate of the burner.

Step 4: When required by the process, the secondary oxidant can be supplied to the burner.

The invention claimed is:

1. A burner (1), comprising a primary fuel conduit (20) comprising a primary fuel outlet (22) having a multiplicity of primary fuel exit holes (23) for supply of a primary fuel into an ignition chamber (25), wherein the wall surrounding the ignition chamber (25) comprises a plurality of bleed holes (28), a main oxidant conduit (30) for supply of a main oxidant, comprising an intermediate annular conduit (35) in a downstream portion (5) of the burner, which intermediate annular conduit (35) is configured to allow splitting of the main oxidant, such that a first portion is introduced into the ignition chamber (25) via the plurality of bleed holes (28) to mix with the primary fuel, and a second portion is introduced into an oxidant section (33);

wherein the burner further comprises a plurality of secondary oxidant conduits (50) for supply of a secondary oxidant, wherein at least in said downstream portion (5) of the burner (1) the primary fuel conduit (20) is surrounded by the main oxidant conduit (30) and the plurality of secondary oxidant conduits (50), wherein the ignition chamber (25) comprises an ignition cup (75) as well as an oxidant bleed cup (76), wherein the ignition cup (75) is comprised in a first section of the ignition chamber (25), and the oxidant bleed cup (76) is comprised in a second section of the ignition chamber (25), wherein the second section is located downstream of the first section.

2. The burner of claim 1, wherein the burner further comprises a secondary fuel conduit (40) for supply of a secondary fuel, having a secondary fuel outlet (44) at its downstream end, wherein at least in the downstream portion (5) of the burner (1), in which primary fuel outlet (22), ignition chamber (25), intermediate annular conduit (35) and secondary fuel outlet (44) are present, the primary fuel conduit (20) is surrounded by the main oxidant conduit (30) and the secondary fuel conduit (40).

3. The burner of claim 2, wherein at least in said downstream portion (5) of the burner (1) the primary fuel conduit (20) is surrounded by the main oxidant conduit (30) and the secondary fuel conduit (40), and the plurality of secondary oxidant conduits (50).

4. The burner of claim 1, wherein i) the oxidant section (33) is a swirler section (33), wherein the intermediate annular conduit (35) is configured to allow splitting of the main oxidant into two portions, wherein a second portion is introduced into the swirler section (33);

and/or ii) the burner (1) further comprises a turbulence generator (47) in the secondary fuel conduit (40).

5. The burner of claim 2, wherein the burner (1) is configured in such a way that, at the exit of a given conduit, i) the velocity of the primary fuel is between 30 ft/s and 500 ft/s; and/or ii) the velocity of the main oxidant is between 5 ft/s and 300 ft/s; and/or iii) the velocity of the secondary fuel is between 20 ft/s and 200 ft/s; and/or iv) the velocity of the secondary oxidant is between 50 ft/s and 500 ft/s.

6. The burner of claim 1, wherein a swirl angle is from 5 to 60 degrees.

7. The burner (1) of claim 2, wherein the burner (1) is operated in such a way that i) during start-up, about 100% of the total thermal power of the burner is provided by the primary fuel; and/or ii) during normal operation, about 25 to 65%, preferably 45 to 65% of the total thermal power of the burner is provided by the primary fuel, and the respective rest is provided by the secondary fuel.

8. A method for operating a burner (1) in accordance with claim 1, the method comprising the steps of i) starting the burner, ii) ramping up the burner in firing rate, iii) starting the secondary fuel, iv) further ramping up the burner to the firing rate of the burner, v) optionally supplying the secondary oxidant to the burner.

9. The method of claim 8, wherein step i) comprises starting the main oxidant, the ignition source, and the primary fuel.

10. A burner (1), comprising a primary fuel conduit (20) comprising a primary fuel outlet (22) having a multiplicity of primary fuel exit holes (23) for supply of a primary fuel into an ignition chamber (25), wherein the wall surrounding the ignition chamber (25) comprises a plurality of bleed holes (28), a main oxidant conduit (30) for supply of a main oxidant, comprising an intermediate annular conduit (35) in a downstream portion (5) of the burner, which intermediate annular conduit (35) is configured to allow splitting of the main oxidant, such that a first portion is introduced into the ignition chamber (25) via the plurality of bleed holes (28) to mix with the primary fuel, and a second portion is introduced into an oxidant section (33);

wherein the burner further comprises a plurality of secondary oxidant conduits (50) for supply of a secondary oxidant, wherein at least in said downstream portion (5) of the burner (1) the primary fuel conduit (20) is surrounded by the main oxidant conduit (30) and the plurality of secondary oxidant conduits (50), wherein the burner further comprises a secondary fuel conduit (40) for supply of a secondary fuel, having a secondary fuel outlet (44) at its downstream end, wherein at least in the downstream portion (5) of the burner (1), in which primary fuel outlet (22), ignition chamber (25), intermediate annular conduit (35) and secondary fuel outlet (44) are present, the primary fuel conduit (20) is surrounded by the main oxidant conduit (30) and the secondary fuel conduit (40), wherein the ignition chamber (25) is positioned within the primary fuel conduit (20), and is extending from the primary fuel outlet (22) to the primary fuel conduit end plane (24), wherein the primary fuel conduit wall (29) is surrounding the ignition chamber (25) and comprises a plurality of bleed holes (28).

11. A burner (1), comprising a primary fuel conduit (20) comprising a primary fuel outlet (22) having a multiplicity of primary fuel exit holes (23) for supply of a primary fuel into an ignition chamber (25), wherein the wall surrounding the ignition chamber (25) comprises a plurality of bleed holes (28), a main oxidant conduit (30) for supply of a main oxidant, comprising an intermediate annular conduit (35) in a downstream portion (5) of the burner, which intermediate annular conduit (35) is configured to allow splitting of the main oxidant, such that a first portion is introduced into the ignition chamber (25) via the plurality of bleed holes (28) to mix with the primary fuel, and a second portion is introduced into an oxidant section (33);

wherein the burner further comprises a plurality of secondary oxidant conduits (50) for supply of a secondary oxidant, wherein at least in said downstream portion (5) of the burner (1) the primary fuel conduit (20) is surrounded by the main oxidant conduit (30) and the plurality of secondary oxidant conduits (50), wherein the ignition chamber (25) is extending from the primary fuel outlet (22) to an intermediate annular conduit exit plane (56), wherein the wall surrounding the ignition chamber (25) comprises at least two (preferably two or three) steps of annular conduits with increasing diameter, each of which comprises a plurality of bleed holes (28).

12. The burner of claim 11, wherein the ignition chamber (25) is extending from the primary fuel outlet (22) to the intermediate annular conduit exit plane (56), wherein the wall surrounding the ignition chamber (25) comprises two sections, wherein i) the first section is extending from the primary fuel outlet (22) to the primary fuel conduit end plane (24), wherein the primary fuel conduit wall (29) surrounding the section comprises a plurality of bleed holes (28), and ii) the second section has an inner diameter greater than the outer diameter of the primary fuel conduit (20), but the second section has an outer diameter smaller than the inner diameter of the intermediate annular conduit (35), and comprises a further plurality of bleed holes (28), and wherein iii) the burner optionally further comprises an air purge plate (73) with purge holes (32) that extends between the first section's outer diameter and the inner diameter of the second section, and iv) the burner optionally further comprises two mechanical mixer plates (74) each located downstream of and adjacent to the said two sections, and v) the burner optionally further comprises a purge plate (73) with purge holes (32) present between the outer diameter of the second section and inner diameter of the intermediate annular conduit (35).

13. The burner of claim 12, wherein the ignition chamber (25) is extending from the primary fuel outlet (22) to the intermediate annular conduit exit plane (56), wherein the wall surrounding the ignition chamber (25) comprises two sections, wherein i) the first section has an outer diameter smaller than the inner diameter of the primary fuel conduit (20) and comprises a plurality of bleed holes (28), wherein the primary fuel conduit wall (29) surrounding the first section comprises a plurality of bleed holes (28), and wherein the first section further comprises means allowing the main oxidant to additionally enter the ignition chamber (25) in flow direction in between two rings of primary fuel exit holes, ii) the second section has an inner diameter greater than the outer diameter of the primary fuel conduit (20), but the second section has an outer diameter smaller than the inner diameter of the intermediate annular conduit (35), and comprises a further plurality of bleed holes (28), and wherein iii) the burner optionally further comprises a purge plate (73) with purge holes (32) present between the first section's outer diameter and inner diameter of the second section, and iv) the burner optionally further comprises a purge plate (73) with purge holes (32) present between the outer diameter of the second section and inner diameter of the intermediate annular conduit (35).

14. The burner of claim 12, wherein the burner (1) further comprises an ignition source (10), wherein the ignition source (10) terminates in the ignition chamber (25), wherein the ignition source (10) is a central ignition source having a central axis (15) and a conduit end plane (16), wherein the main axis (2) of the burner (1) coincides with the central axis (15) of the ignition source (10), wherein at least in said downstream portion (5) of the burner (1) the central spark igniter (10) is surrounded by the primary fuel conduit (20), the main oxidant conduit (30) and the secondary fuel conduit (40), and the plurality of secondary oxidant conduits (50).

15. The burner of claim 14, wherein i) the primary fuel conduit end plane (24) corresponds to the ignition chamber end plane (26); and/or ii) the primary fuel conduit further comprises air premixing holes (27) upstream of the primary fuel outlet (22); and/or iii) the main oxidant conduit (30) further comprises purge holes (32) in flow direction parallel to the main axis (2) of the burner.

16. The burner of claim 15, wherein i) the diameter of the primary fuel exit holes (23) is defined as D0, wherein D0/D2 is between 0.04 and 0.5; and/or ii) the diameter of the purge holes (32) is defined as D1, wherein D1/D2 is between 0.04 and 0.5 and/or iii) the outer diameter of the ignition source (10) is defined as D2 and the inner diameter of the primary fuel conduit (20) is defined as D3, wherein D3/D2 is from 1.5 to 4.5; and/or iv) the outer diameter of the ignition source (10) is defined as D2 and the inner diameter of the main oxidant conduit (30) is defined as D4, wherein D4/D2 is from 3.0 to 9.0; and/or v) the outer diameter of the ignition source (10) is defined as D2 and the inner diameter of the secondary fuel conduit (40) is defined as D5, wherein D5/D2 is from 5.0 to 11.0; and/or vi) the outer diameter of the ignition source (10) is defined as D2 and the distance between the centers of two secondary oxidant conduits (50) located opposite from each other in relation to the main axis (2) of the burner is defined as D6, wherein D6/D2 is from 9.0 to 22.0; and/or vii) the inner diameter of the secondary fuel conduit (40) is defined as D5 and the distance between the centers of two secondary oxidant conduits (50) located opposite from each other in relation to the main axis (2) of the burner is defined as D6, wherein D6/D5 is from 1.75 to 2.5; and/or viii) the diameter of the air premixing holes (27) is defined as P0, wherein P0/D2 is between 0.02 and 0.2; and/or ix) the inner diameter of the bleed holes (28) is defined as P1; wherein P1/D2 is between 0.05 and 0.4; and/or X) the distance between the primary fuel conduit end plane (24) and the intermediate annular conduit end plane (36) is defined as L1 and the distance between the primary fuel conduit wall (29) and the intermediate annular conduit wall (37) is defined as L4, wherein L1/L4 is from 0.5 to 2.5; and/or Xi) the distance between the primary fuel conduit end plane (24) and the intermediate annular conduit end plane (36) is defined as L1, the distance between the intermediate annular conduit end plane (36) and the main oxidant conduit end plane (38) is defined as L2 and the inner diameter of the primary fuel conduit (20) is defined as D3, wherein (L1+L2)/D3 is from 0.25 to 1.0; and/or xii) the distance between the main oxidant conduit end plane (38) and the secondary fuel conduit end plane (46) is defined as L3, and the inner diameter of the main oxidant conduit (30) is defined as D4, wherein L3/D4 is from 0.05 to 0.25; and/or xiii) wherein the distance between the primary fuel outlet (22) and the primary fuel conduit end plane (24) and/or ignition chamber end plane (26) is defined as L0 and the inner diameter of the primary fuel conduit (20) is defined as D3, wherein L0/D3 is from 0.25 to 1.0; and/or xiv) the distance between two rows of bleed holes (28) measured between their centers is defined as H and the inner diameter of the bleed holes (28) is defined as P1, wherein H/P1 is from 1.25 to 2.5; and/or xv) the inner diameter of the secondary oxidant conduits (50) is defined as D7, wherein D7/D2 is between 0.15 to 1.0.

17. The burner of claim 14, wherein i) the ratio of area of all bleed holes in one row to the surface area of cylinder of height, P1 and inner diameter, D2 is between 10% and 55%; and/or ii) the purge air plate (73) has porosity (defined by the total open area on the plate that allows the air to flow divided by cross-section area of the plate) in limit of 2% to 15%; and/or iii) the primary fuel exit plate (72) has porosity (defined by the total open area on the plate that allows the fuel to flow divided by cross-section area of the plate) in range of of 2% to 25%, iv) the angle defined by the main axis (2) of the burner and the centers of two adjacent secondary oxidant conduits (50) is defined as angle eta, wherein angle eta is from 10 to 70 degrees.

18. A burner (1), comprising a primary fuel conduit (20) comprising a primary fuel outlet (22) having a multiplicity of primary fuel exit holes (23) for supply of a primary fuel into an ignition chamber (25), wherein the wall surrounding the ignition chamber (25) comprises a plurality of bleed holes (28), a main oxidant conduit (30) for supply of a main oxidant, comprising an intermediate annular conduit (35) in a downstream portion (5) of the burner, which intermediate annular conduit (35) is configured to allow splitting of the main oxidant, such that a first portion is introduced into the ignition chamber (25) via the plurality of bleed holes (28) to mix with the primary fuel, and a second portion is introduced into an oxidant section (33);

wherein the burner further comprises a plurality of secondary oxidant conduits (50) for supply of a secondary oxidant, wherein at least in said downstream portion (5) of the burner (1) the primary fuel conduit (20) is surrounded by the main oxidant conduit (30) and the plurality of secondary oxidant conduits (50), wherein the burner (1) is operated in such a way that i) a volumetric flow rate of the ignition chamber oxidant is about 5 to 25% of the total main oxidant flow rate; and/or ii) a volumetric flow rate of premixed oxidant is about 2 to 10% of the total main oxidant flow rate; and/or iii) a volumetric flow rate of the oxidant diverted to the secondary oxidant conduits (50) is about 2 to 5% of the main oxidant flow rate.

19. A burner (1), comprising a primary fuel conduit (20) comprising a primary fuel outlet (22) having a multiplicity of primary fuel exit holes (23) for supply of a primary fuel into an ignition chamber (25), wherein the wall surrounding the ignition chamber (25) comprises a plurality of bleed holes (28), a main oxidant conduit (30) for supply of a main oxidant, comprising an intermediate annular conduit (35) in a downstream portion (5) of the burner, which intermediate annular conduit (35) is configured to allow splitting of the main oxidant, such that a first portion is introduced into the ignition chamber (25) via the plurality of bleed holes (28) to mix with the primary fuel, and a second portion is introduced into an oxidant section (33);

wherein the burner further comprises a plurality of secondary oxidant conduits (50) for supply of a secondary oxidant, wherein at least in said downstream portion (5) of the burner (1) the primary fuel conduit (20) is surrounded by the main oxidant conduit (30) and the plurality of secondary oxidant conduits (50), wherein the burner (1) is operated in such a way that, during normal operation, the burner can be turned down from 100% design firing rate to about 1:30 turndown, depending on the operation requirements.

* * * * *